US009915908B2

(12) United States Patent
Kosaka

(10) Patent No.: US 9,915,908 B2
(45) Date of Patent: Mar. 13, 2018

(54) IMAGE FORMING APPARATUS WITH VARYING HEATER VOLTAGE

(71) Applicant: Oki Data Corporation, Tokyo (JP)

(72) Inventor: Toru Kosaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/271,219

(22) Filed: Sep. 20, 2016

(65) Prior Publication Data

US 2017/0090396 A1 Mar. 30, 2017

(30) Foreign Application Priority Data

Sep. 28, 2015 (JP) ..... 2015-189931

(51) Int. Cl.
*G03G 15/00* (2006.01)
*G03G 15/20* (2006.01)

(52) U.S. Cl.
CPC ..... *G03G 15/80* (2013.01); *G03G 15/2039* (2013.01); *G03G 15/5004* (2013.01)

(58) Field of Classification Search
CPC ..... G03G 15/2039; G03G 15/80; G03G 15/5004; G03G 15/2078
See application file for complete search history.

(56) References Cited

U.S. PATENT DOCUMENTS 4,928,055 A 5/1990 Kaieda et al.
2009/0074442 A1 3/2009 Sano et al.
2015/0093134 A1* 4/2015 Itoh ..... G03G 15/2039 399/67

FOREIGN PATENT DOCUMENTS

JP 2001-343858 A 12/2001
JP 2013-235107 A 11/2013

* cited by examiner

*Primary Examiner* — Hoang Ngo
(74) *Attorney, Agent, or Firm* — Rabin & Berdo, P.C.

(57) ABSTRACT

An image forming apparatus includes a power supply voltage detector, a power supply cycle detector, a voltage converter, and a controller. The power supply voltage detector detects a power supply voltage value of a commercial alternating-current voltage. The power supply cycle detector detects a power supply cycle of the commercial alternating-current voltage. The voltage converter performs switching of the commercial alternating-current voltage, and thereby converts the commercial alternating-current voltage into a heater alternating-current voltage to be applied to a heater. The controller controls the voltage converter and thereby generates the heater alternating-current voltage, on a basis of the power supply voltage value detected by the power supply voltage detector and the power supply cycle detected by the power supply cycle detector. The heater alternating-current voltage has an effective value that is stepped down from an effective value of the commercial alternating-current voltage, and is synchronized with the power supply cycle.

12 Claims, 16 Drawing Sheets

IMAGE FORMING APPARATUS WITH VARYING HEATER VOLTAGE

CROSS REFERENCE TO RELATED APPLICATIONS

This application claims the benefit of Japanese Priority Patent Application JP2015-189931 filed on Sep. 28, 2015, the entire contents of which are incorporated herein by reference.

BACKGROUND

The invention relates to an image forming apparatus that is suitable for, for example, a color electrophotographic printer including a heater that heats a medium for image formation.

In an existing image forming apparatus, a heater of a fixing unit is coupled to a commercial AC power supply through a triac (a bidirectional thyristor). The image forming apparatus applies an AC voltage that is supplied from the commercial AC power supply to the heater in response to on-operation by the phase control of the triac, thereby controlling heating temperature of the heater (for example, Japanese Unexamined Patent Application Publication No. 2013-235107).

SUMMARY

There are various commercial AC power supplies with different power supply voltage values from one another. In a case, however, where a device that directly turns on or off a commercial AC power supply, such as a triac is used, it is necessary to prepare different fixing unit corresponding to the image forming apparatus, depending on the power supply voltage value.

It is desirable to provide an image forming apparatus with improved functionality.

An image forming apparatus according to an illustrative embodiment of the invention includes: a power supply voltage detector that detects a power supply voltage value of a commercial alternating-current voltage that is within a predetermined input alternating-current voltage range, in which the commercial alternating-current voltage is supplied from a commercial alternating-current power supply; a power supply cycle detector that detects a power supply cycle of the commercial alternating-current voltage; a voltage converter that performs switching of the commercial alternating-current voltage, and thereby converts the commercial alternating-current voltage into a heater alternating-current voltage to be applied to a heater, in which the heater is provided in a fixing unit that heats a medium; and a controller that controls the voltage converter and thereby generates the heater alternating-current voltage, on a basis of the power supply voltage value detected by the power supply voltage detector and the power supply cycle detected by the power supply cycle detector. The heater alternating-current voltage has an effective value that is stepped down from an effective value of the commercial alternating-current voltage, and is synchronized with the power supply cycle.

DETAILED DESCRIPTION

In the following, some example embodiments of the invention are described with reference to the drawings.

1. First Embodiment

[1-1. Internal Configuration of Color Printer]

Figure 1:
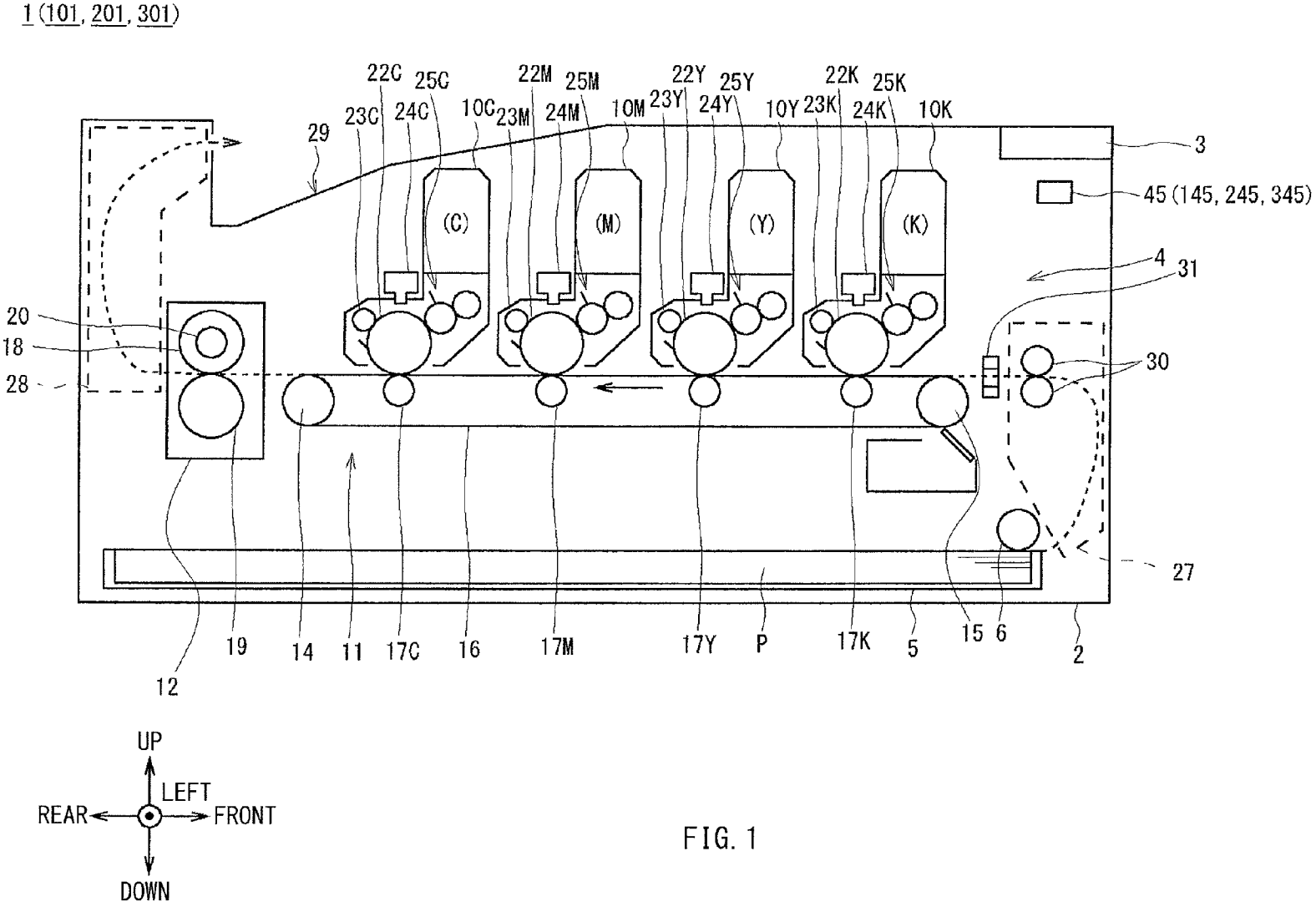
FIG. 1 is a side view of an internal configuration of a color printer.

As illustrated in FIG. 1, a color printer 1 may be a primary transfer printer, and include a box-shaped printer housing 2. The color printer 1 forms a print image on a surface of a print medium P such as recording paper and a film used for formation of the print image. A display section 3 that displays various pieces of information may be disposed on a front end of a top surface of the printer housing 2. In the printer housing 2, an image forming section 4 that forms the print image on the surface of the print medium P may be disposed at a center, and a medium cassette 5 in which a plurality of print media P are loaded and a hopping roller 6 that feeds the print medium P one by one from the medium cassette 5 may be disposed. The image forming section 4 includes image forming units 10 (10K, 10Y, 10M, and 10C), a transferring unit 11, and a fixing unit 12. The image forming units 10K, 10Y, 10M, and 10C use corresponding one of color toners including four colors of black (K), yellow (Y), magenta (M), and cyan (C), while avoiding overlapping use of the colors, to form respective toner images that are base of the print image. In the transferring unit 11, an endless transfer belt 16 may be stretched by a belt driving roller 14 and a driven roller 15, and surfaces of transfer rollers 17 (a black transfer roller 17K, a yellow transfer roller 17Y, a magenta transfer roller 17M, and a cyan transfer roller 17C) may be pressed against respective photosensitive drums 22 (22K, 22Y, 22M, and 22C) with the transfer belt 16 in between, thereby transferring the toner images on the surfaces of the image forming units 10. In the fixing unit 12, a heater 20 that may be a halogen heater may be inserted into a hollow pipe-shaped heating roller 18, and a surface of a pressure roller 19 may be pressed against a surface of the heating roller 18, thereby fixing the toner images as the print image on the surface of the print medium P through heating and applying pressure.

The image forming units 10 (10K, 10Y, 10M, and 10C) form corresponding electrostatic latent images on the surface of the respective photosensitive drums 22 (22K, 22Y, 22M, and 22C) through exposure by light emitting diode (LED) heads 24 (a black LED head 24K, a yellow LED head 24Y, a magenta LED head 24M, and a cyan LED head 24C) after charging by charging rollers 23 (23K, 23Y, 23M, and 23C). The electrostatic latent images may be developed by respective developing sections 25 (a black developing section 25K, a yellow developing section 25Y, a magenta developing section 25M, and a cyan developing section 25C) with use of a corresponding single color toner. Following these processes, the toner images may be formed. The developing sections 25 each include a developing roller and a supplying roller. The image forming units 10 (10K, 10Y, 10M, and 10C) may be configured similarly to one another.

In the printer housing 2, a medium supply conveying section 27 that forms a medium supply conveying path may be disposed at a front lower end. The medium supply conveying path may be designed to convey the print medium P that is fed out from the medium cassette 5, to the image forming section 4. In addition, in the printer housing 2, a medium discharge conveying section 28 that forms a medium discharge conveying path may be disposed at a rear upper end. The medium discharge conveying path may be designed to convey the print medium P that is fed out from the fixing unit 12, to a discharge tray 29. The medium supply conveying section 27 may include a pair of resist rollers 30 provided in the middle of the medium supply conveying path. The resist rollers 30 may make the front end, in a medium conveying direction, of the print medium P parallel to a printer lateral direction to thereby correct the conveying attitude of the print medium P, and control timing at which formation of the toner images by the image forming units 10 is started. Also, in the printer housing 2, a medium detection sensor 31 may be disposed between the medium supply conveying section 27 and the image forming section 4. The medium detection sensor 31 detects presence or absence of passage of the print medium P that is conveyed from the medium supply conveying section 27 to the image forming section 4, in contact or non-contact manner. In a case where an input alternating-current (abbreviated to "AC" hereinafter) voltage effective value that is an effective value of an inputted AC voltage is 100 [V], the rated power consumption value of the entire color printer 1 may be 1500 [W] and the rated current value may be 10 [A]. In a case where the input AC voltage effective value is 200 [V], the rated power consumption value of the entire color printer 1 may be 2000 [W] and the rated current value may be 10 [A].

[1-2. Circuit Configuration of Color Printer]

Figure 2:
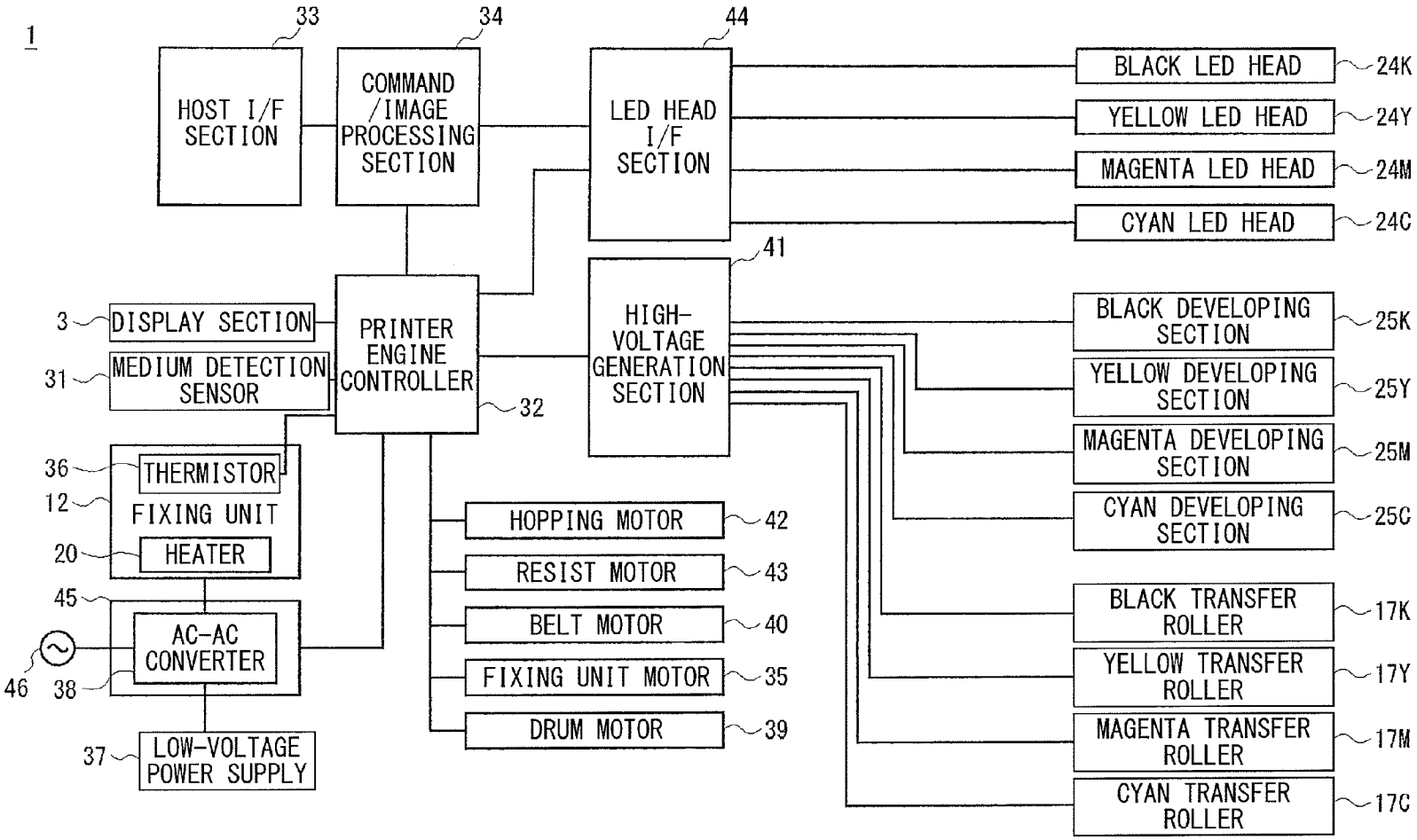
FIG. 2 is a block diagram illustrating a circuit configuration of a color printer according to a first embodiment.

As illustrated in FIG. 2, for example, the color printer 1 may include: a printer engine controller 32 having a microprocessor configuration; a host interface section 33 that communicates with an unillustrated external host computer; and a command/image processing section 34 that acquires, through the host interface section 33, a control command and print data transmitted from the host computer to perform a predetermined process.

The printer engine controller 32 may control the entire color printer 1 to perform image formation on the print medium P, for example, in accordance with various kinds of programs such as a basic program previously held in an internal memory and an application program, e.g., an image formation processing program. In addition, the printer engine controller 32 may execute various processing such as predetermined calculation processing and a display processing to display various pieces of information on the display section 3. Thus, for example, when an image formation instruction command that instructs formation of the print image, a size instruction command that instructs a size of the print medium P on which the print image is to be formed, and print data indicating a color image to be printed that may be described in page description language (PDL) are transmitted from the host computer, the printer engine controller 32 receives these commands and data by the host interface section 33 and takes these commands and data in the command/image processing section 34. Thereafter, when a print instruction command and the size instruction command are provided from the command/image processing section 34, the printer engine controller 32 executes the print image formation processing to form the print image on the surface of the print medium P, in response to the commands. At this time, the printer engine controller 32 operates a fixing unit motor 35 to rotate the heating roller 18 of the fixing unit 12 in a first rotation direction, and to rotate the pressure roller 19 in the second rotation direction in conjunction with the rotation of the heating roller 18. Also, the printer engine controller 32 controls a heater 20 corresponding to the size of the print medium P that is indicated by the size instruction command, out of the heaters 20 of the fixing unit 12.

Thereafter, the printer engine controller 32 detects the surface temperature of the heating roller 18 with use of a thermistor 36 that is provided in the fixing unit 12, and controls the power supply section 45 according to the detection result. An AC-AC converter 38 of the power supply section 45 may be coupled to any of the commercial AC power supplies 46 that generate a commercial AC voltage within an input AC voltage range in which a power supply voltage value is from 100 [V] to 230 [V], and may be coupled to the optionally-selected commercial AC power supply 46. Also, a low-voltage power supply 37 may be configured separately from the power supply section 45. The low-voltage power supply 37 generates, with use of an AC-DC converter, a DC voltage having a voltage value of, for example, 24 [V] or 5 [V] from the commercial AC voltage that is supplied from the commercial AC power supply 46 through the power supply section 45, and supplies the DC voltage as an operation voltage to each section in the color printer 1. Accordingly, the printer engine controller 32 generates a heater AC voltage that is an AC voltage to allow the heater 20 to be controlled to generate heat, with use of the AC-AC converter 38, and applies the generated heater AC voltage to the heater 20 to be controlled in the fixing unit 12. In this way, the printer engine controller 32 allows the heater 20 to be controlled in the fixing unit 12 to generate heat to heat the heating roller 18, thereby increasing the surface temperature of the heating roller 18 to predetermined temperature.

In this state, the printer engine controller 32 operates a drum motor 39 to rotate the photosensitive drums 22 in the respective image forming units 10 in the first rotation direction, and to rotate the developing roller and the supplying roller of the developing section 25 in the second rotation direction in conjunction with the rotation of the photosensitive drums 22. Further, the printer engine controller 32 operates a belt motor 40 to rotate the belt driving roller 14 of the transferring unit 11 in the second rotation direction, and to rotate the driven roller 15 and the transfer belt 16 in the second rotation direction, in conjunction with the rotation of the belt driving roller 14. Also, the printer engine controller 32 causes a high-voltage generation section 41 to generate various high-voltages of plus or minus, and applies the high voltages to the corresponding charging rollers 23, the corresponding developing sections 25, and the corresponding transfer rollers 17. Thus, the printer engine controller 32 causes the charging roller 23 to charge the surface of the photosensitive drum 22 at the predetermined potential, and causes the supplying roller of the developing section 25 to supply a toner to the surface of the developing roller, thereby causing the surface of the developing roller to support the toner, in the image forming unit 10. In addition, the printer engine controller 32 operates an unillustrated conveying motor to rotate a plurality of conveying rollers of the medium supply conveying section 27 and the medium discharge conveying section 28 in the first rotation direction or the second rotation direction. Further, the printer engine controller 32 operates a hopping motor 42 to rotate the hopping roller 6 in the second rotation direction, thereby causing the hopping roller 6 to feed the print medium P one by one from the medium cassette 5 to convey the print medium P to the image forming section 4 through the medium supply conveying path. At this time, for example, the printer engine controller 32 may stop the rotation of the pair of resist rollers 30 to cause the front end of the print medium P to butt the resist rollers 30, thereby correcting the conveyed attitude of the print medium P. Thereafter, the printer engine controller 32 may operate the resist motor 43 to rotate the resist rollers 30 in the first rotation direction and the second rotation direction that are opposite to each other, thereby conveying the print medium P to the image forming section 4 again.

At this time, the printer engine controller 32 converts, by the command/image processing section 34, the print data into bit map data that represents color components of black, yellow, magenta, and cyan of the color images to be printed, and transmits the bit map data to an LED head interface section 44. Thereafter, the printer engine controller 32 may start to transmit the bit map data corresponding to black from the LED head interface section 44 to the black LED head 24K at timing when the print medium P is restarted to be conveyed by the pair of resist rollers 30. Thereafter, the printer engine controller 32 may start to sequentially transmit the bit map data corresponding to yellow, magenta, and cyan to the yellow LED head 24Y, the magenta LED head 24M, and the cyan LED head 24 at respective predetermined timings. The printer engine controller 32 performs on-off control on the LED heads 24 for exposure of the surface of the photosensitive drums 22, on the basis of these bit map data. Thus, the printer engine controller 32 sequentially causes the image forming units 10 to start formation of the toner images, thereby forming the toner images on the surface of the photosensitive drums 22 as mentioned above. Also, the printer engine controller 32 sequentially transfers, by the transfer rollers 17, the toner images on the surfaces of the respective photosensitive drums 22 to the surface of the print medium P such that the toner images are overlapped with one another, while conveying the print medium P that has been conveyed through the medium supply conveying path with sandwiching the print medium P between the photosensitive drums 22 and the transfer belt 16. Further, the printer engine controller 32 heats and applies pressure to form the color print image on the surface of the print medium P while continuously conveying the print medium P with sandwiching the print medium P between the heating roller 18 and the pressure roller 19 in the fixing unit 12. Thereafter, the printer engine controller 32 discharges the print medium P onto the discharge tray 9 through the medium discharge conveying path. The printer engine controller 32 forms the color print image on the surface of the print medium P with any of various sizes in this way.

[1-3. Circuit Configuration of Power Supply Section]

Figure 3:
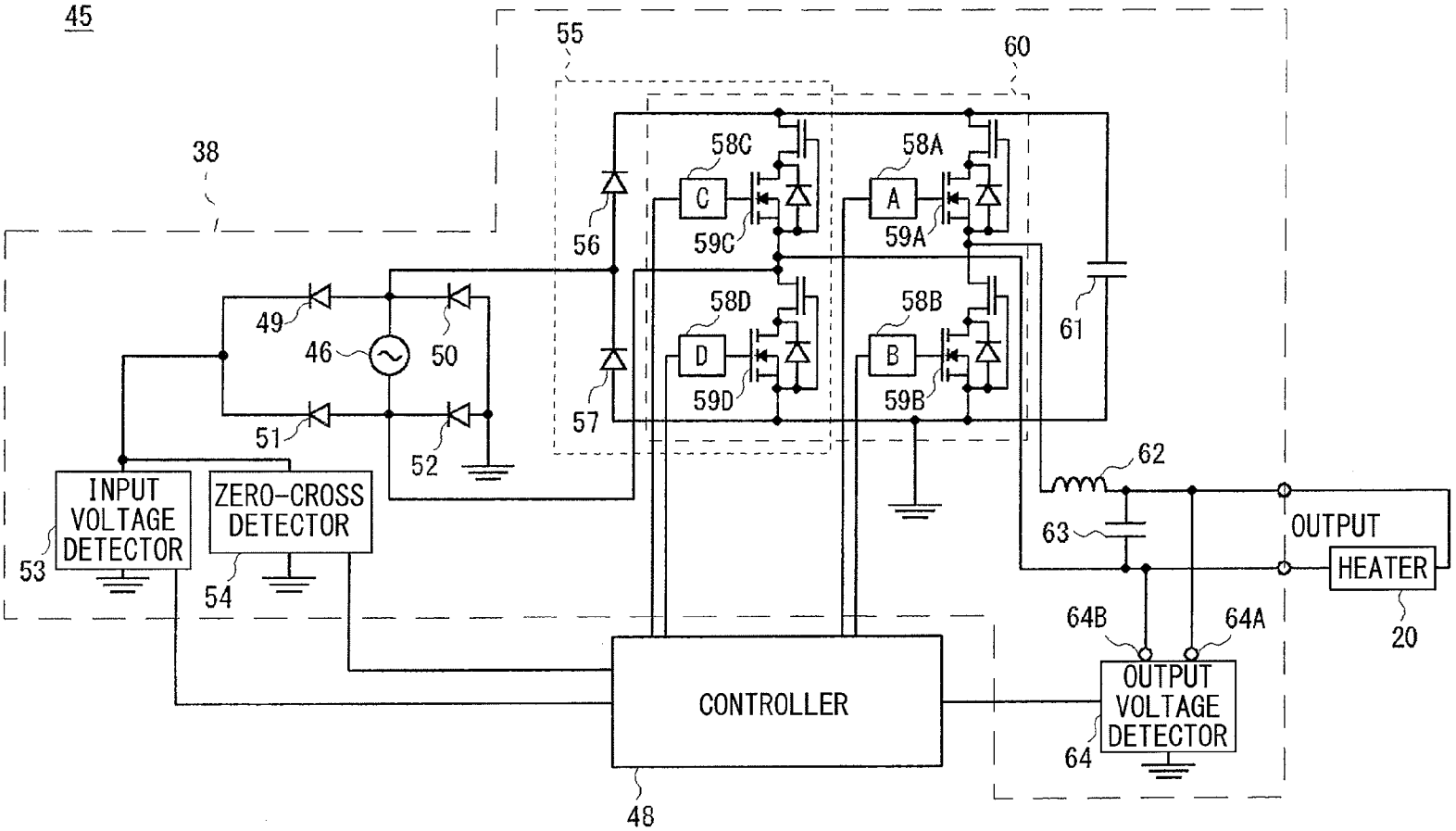
FIG. 3 is a block diagram illustrating a circuit configuration of a power supply section according to the first embodiment.

As illustrated in FIG. 3, the power supply section 45 has the AC-AC converter 38. For example, a controller 48 that may be a logic integrated circuit such as a microcomputer, an application specific integrated circuit (ASIC), and a field-programmable gate array (FPGA) may control the power supply section 45 as a whole. The controller 48 operates in response to an operation voltage supplied from the low-voltage power supply 37 (FIG. 2).

Figure 4:
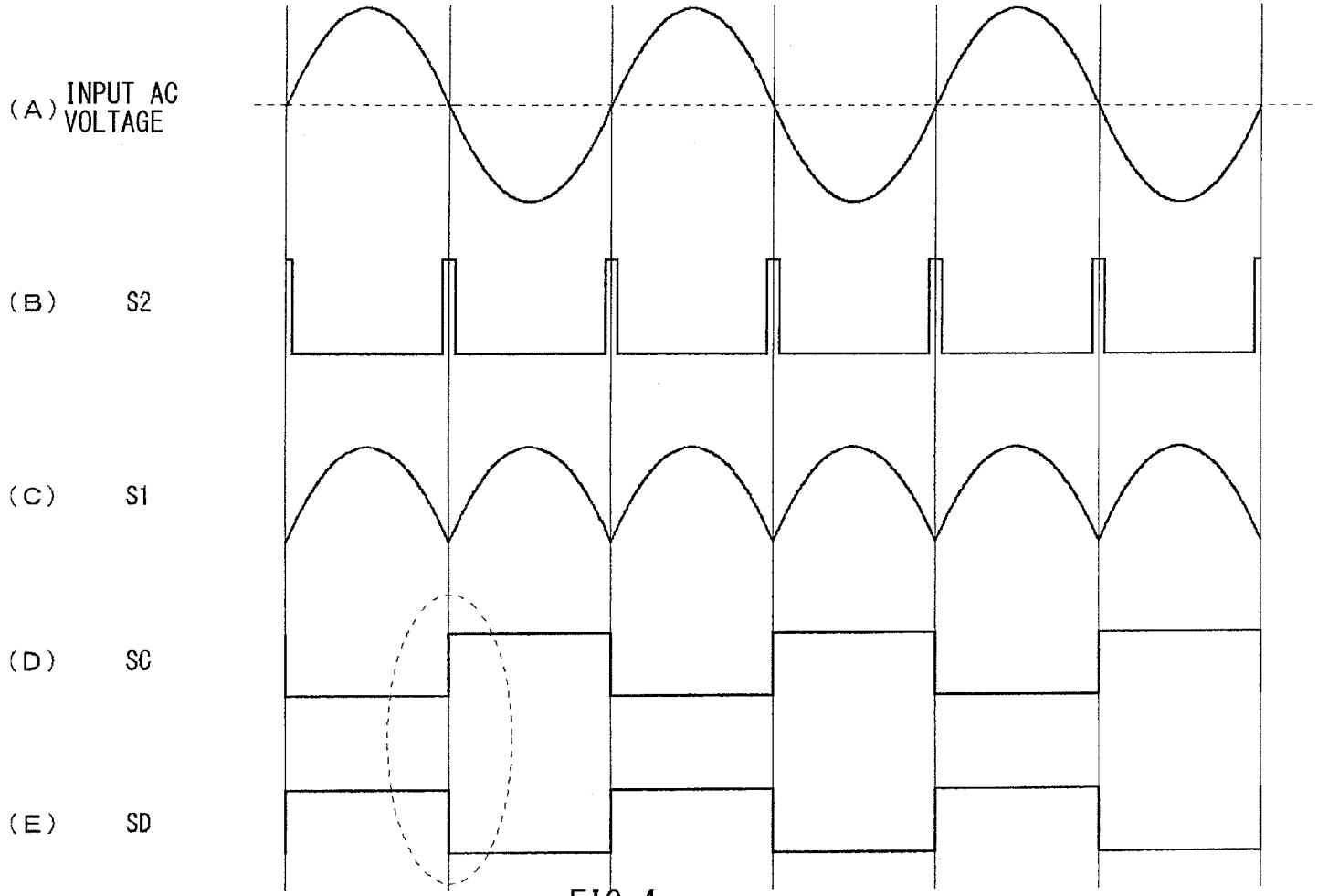
FIG. 4 is a timing chart illustrating an input AC voltage, a zero-cross detection signal, an input voltage detection signal, and gate signals.

The commercial AC power supply 46 supplies the AC-AC converter 38 with a voltage within an AC range from 100 [V] to 230 [V] as the input alternating voltage, as illustrated in (A) of FIG. 4. The heater 20 may have the rated input voltage value of 80 [V]. For example, in a case of the heater that has the rated input voltage value of AC 80 [V] and the rated power consumption value of 800 [W], a current having an effective value of 10 [A] may flow to cause the heater 20 to generate heat when the heater AC voltage effective value is 80 [V]. The heater AC voltage effective value is an effective value of the heater AC voltage value that is a value of the heater AC voltage. The power supply section 45 outputs, as the output AC voltage, the heater AC voltage having the heater AC voltage effective value of 80 [V] that is the rated input voltage value of the heater 20, and applies the voltage to the heater 20, irrespective of the voltage value that is supplied from the commercial AC power supply 46.

When the commercial AC voltage is applied as the input AC voltage from the commercial AC power supply 46, the input AC voltage may be subjected to full-wave rectification by the diodes 49, 50, 51, and 52 each of which may be a bridge diode, and the full-wave rectified voltage may be provided to an input voltage detector 53. The input voltage detector 53 steps down the full-wave rectified input AC voltage to generate an input voltage detection signal S1 illustrated in (C) of FIG. 4, and provides the input voltage detection signal S1 to an AD converter of the controller 48. The controller 48 samples the input voltage detection signal S1 in a predetermined time to calculate the real-time voltage value and an average value that is for each AC cycle as a power supply cycle, thereby acquiring the input AC voltage effective value that is the voltage effective value of the input AC voltage. Note that the controller 48 may smooth the input AC voltage with use of a resistor and capacitor in a circuit to detect the smoothed voltage, thereby acquiring the input AC voltage effective value, without being limited to a method of calculating the input AC voltage effective value through the detection and the operation of the input AC voltage.

A zero-cross detector 54 generates a zero-cross detection signal S2 illustrated in (B) of FIG. 4, from the voltage waveform of the full-wave rectified input AC voltage, and provides the zero-cross detection signal S2 to the controller 48. The zero-cross detection signal S2 may be a pulse synchronized with zero-cross timing of alternating current (AC). The controller 48 detects a zero-cross point of the input AC voltage from the zero-cross detection signal S2. Note that, although delay may occur depending on the circuit configuration of the zero-cross detector 54, for example, a counter may be used in the controller 48 to appropriately adjust the timing.

A full-wave rectification circuit 55 may be coupled to both ends of the respective bridge diodes, and the controller 48. The full-wave rectification circuit 55 may include diodes 56 and 57, gate drive circuits 58C and 58D, and gallium nitride power devices 59C and 59D, and performs full-wave rectification on the input AC voltage. The gate drive circuits 58C and 58D may be respectively controlled by gate signals SC and SD that are supplied from the controller 48.

A full-bridge circuit 60 may be coupled to a capacitor 61, an inductor 62, a capacitor 63, and the controller 48. The full-bridge circuit 60 may include gate drive circuits 58A and 58B, gallium nitride power devices 59A and 59B, the gate drive circuits 58C and 58D, and the gallium nitride power devices 59C and 59D. The full-bridge circuit 60 performs switching of the input AC voltage. The full-bridge circuit 60 may share the gate drive circuits 58C and 58D and the gallium nitride power devices 59C and 59D with the full-wave rectification circuit 55. The gate drive circuits 58A and 58B may be respectively controlled by the gate signals SA and SB that are supplied from the controller 48. The gate signals SA, SB, SC, and SD may be collectively referred to as a gate signal in the following.

The inductor 62 and the capacitor 63 may configure an LC filter. An output voltage detector 64 may be coupled to an output terminal of the AC-AC converter 38 that is coupled to the heater 20, detects the heater AC voltage, and provides the detection result to the controller 48.

When the input voltage detection signal S1 exceeds a predetermined threshold (for example, the input AC voltage of 85 [V]), the controller 48 respectively provides the gate drive circuits 58C and 58D with the gate signals SC and SD that are pulse signals illustrated in (D) and (E) of FIG. 4, for control of the frequency of the heater AC voltage, as illustrated in the timing chart of FIG. 4. The gate drive circuits 58C and 58D respectively transmit the gate signals SC and SD through isolated signal transmitting circuits such as photo-couplers, and outputs pulses of voltage amplitude necessary for gate driving of the gallium nitride power devices 59C and 59D. Thus, the full-wave rectification circuit 55 alternately switches the gallium nitride power devices 59C and 59D in accordance with the input AC voltage, thereby applying the full-rectified voltage to both ends of the capacitor 61 between a drain of the gallium nitride power device 59A and a source of the gallium nitride power device 59B in the full-bridge circuit 60.

The controller 48 generates the gate signals SC and SD as a pair of inversion signals so as to prevent the gallium nitride power devices 59C and 59D from being turned on concurrently due to changes in logic level of the gate signals SC and SD, thereby preventing a through current from flowing therethrough. The pair of inversion signals has a relationship in which one of the signals has a waveform inverted from a waveform of the other signal.

Figure 7:
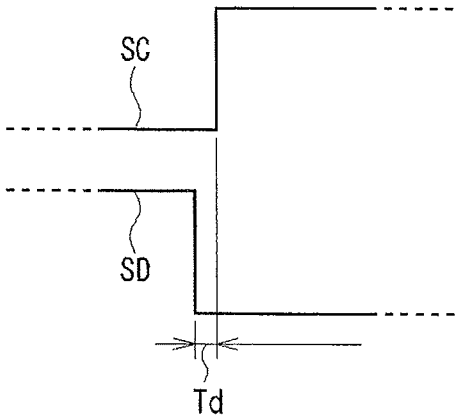
FIG. 7 is a waveform diagram illustrating a dead time.

If a period of a logic "H" level and a period of a logic "L" level of the gate signals SC and SD are each accurately set to ½ period and one of the gate signals SC and SD is delayed from the other signal, both signals may change to "H" level concurrently to cause a time in which both the gallium nitride power devices 59C and 59D are turned on. Thus, as illustrated in FIG. 7 that serves as an enlarged diagram of a region surrounded by a dashed line in FIG. 4, the controller 48 provides a dead time Td at switching time point of the logic level of one of the gate signals SC and SD, thereby avoiding the gallium nitride power devices 59C and 59D from being turning on concurrently. The dead time Td may be a period in which both the gate signals SC and SD are set to "L" level. FIG. 7 illustrates a state in which the gate signal SC is switched from "L" level to "H" level and the gate signal SD is switched from "H" level to "L" level. The dead time Td may be also provided in a state in which the gate signal SC is switched from "H" level to "L" level and the gate signal SD is switched from "L" level to "H" level.

Figure 5:
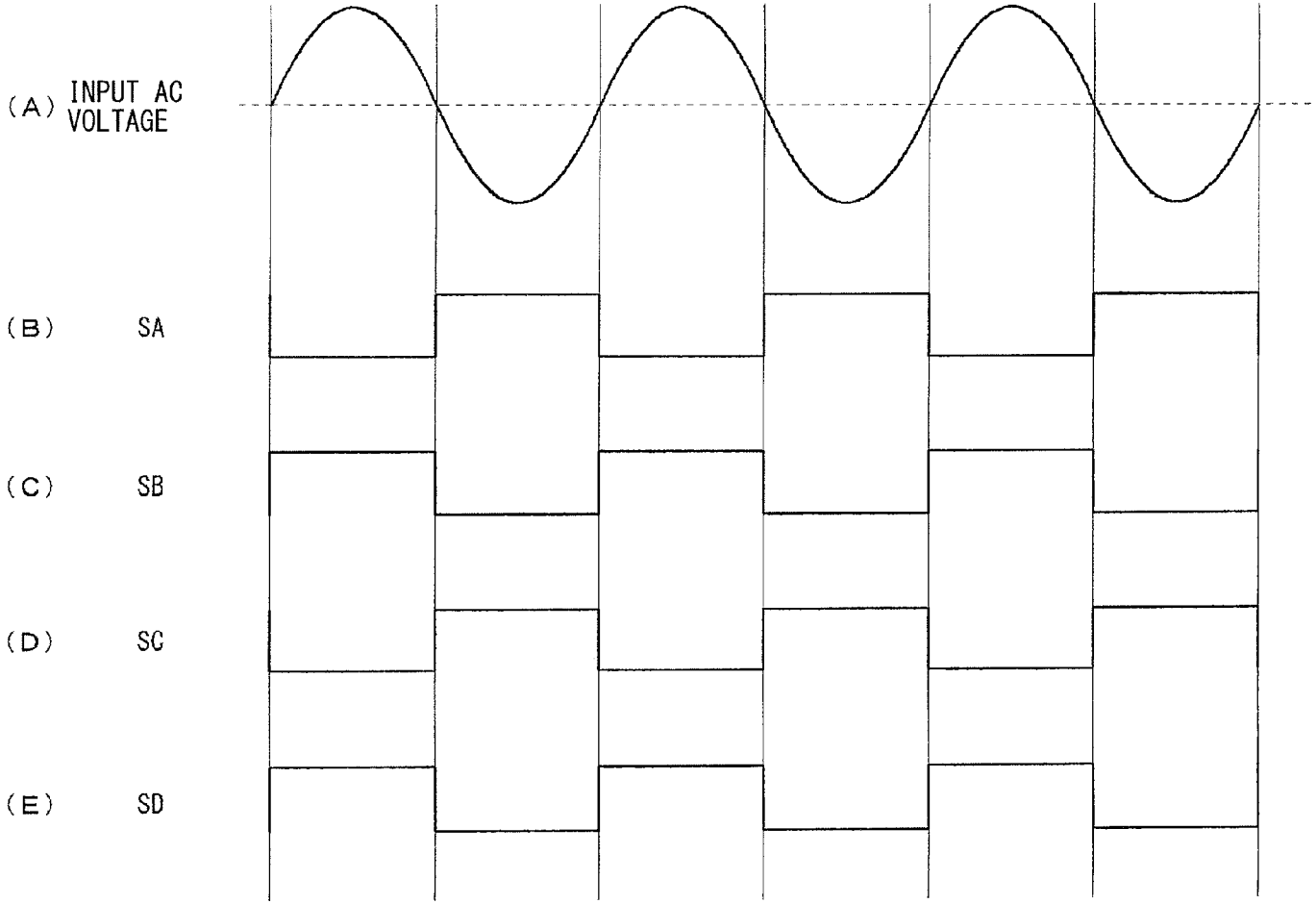
FIG. 5 is a timing chart illustrating an input AC voltage and gate signals in an initial state.

Operation of the full-bridge circuit 60 is described with reference to FIG. 5 and FIG. 6. The controller 48 starts to drive the gate drive circuits 58A and 58B in synchronization with driving start of the gate drive circuits 58C and 58D. FIG. 5 is a timing chart of a print initial state in which the color printer 1 has not started printing operation. As illustrated in FIG. 5, in the initial state, the controller 48 concurrently turns on the circuit pair on low side (the gate drive circuits 58D and 58B) and concurrently turns on the circuit pair on high side (the gate drive circuits 58C and 58A), in synchronization with the power supply cycle. In this case, the controller 48 generates the gate signals SA and SB as the pair of inversion signals that has relationship in which one of the signals has a waveform inverted from a waveform of the other signal, in order to prevent the gallium nitride power devices 59A and 59B from being turned on concurrently and prevent a through-current from flowing due to the changes in the logic level of the gate signals SA and SB. The heater AC voltage may be applied to the heater 20 only in a case where both the gate signals SA and SD are at "H" level and both the gate signals SB and SC are at "L" level or a case where both the gate signals SB and SC are at "H" level and both the gate signals SA and SD are at "L" level. Thus, in the initial state illustrated in FIG. 5, the heater AC voltage may not be applied to the heater 20.

Thereafter, when the color printer 1 starts the print operation, the printer engine controller 32 supplies a heater-on signal to the controller 48 at predetermined timing. The controller 48 applies the voltage to the heater 20 in accordance with the heater-on signal. The printer engine controller 32 may notify the controller 48 of on or off of the heater-on signal, on the basis of the temperature detected by the thermistor 36.

Figure 6:
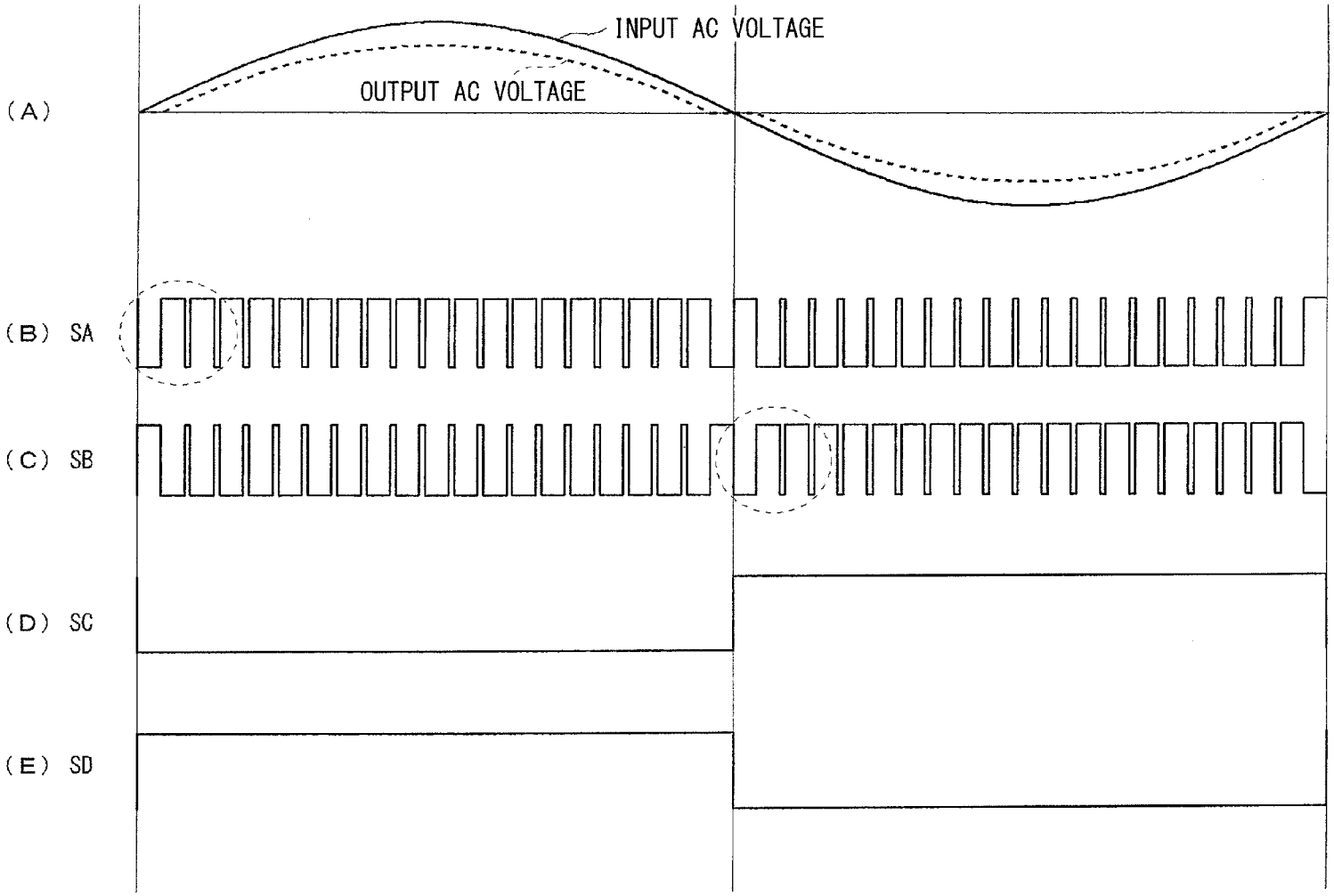
FIG. 6 is a timing chart illustrating an input AC voltage and gate signals in a printing operation state.

When the color printer 1 makes transition to the printing operation state to perform energization to the heater 20, the controller 48 sets the gate signal SD to "H" level and sets the gate signal SA to "H" level at a predetermined duty ratio in a half period in which the input AC voltage is positive, as illustrated in the timing chart of the printing operation state of FIG. 6. In contrast, the controller 48 sets the gate signal SC to "H" level and sets the gate signal SB to "H" level at a predetermined duty ratio in a half period in which the input AC voltage is negative. As mentioned above, the gate signals SA and SB may be inverted in waveform from each other, and the gate signals SC and SD may be inverted in waveform from each other. Thus, in the half period in which the input AC voltage is positive, a current may flow through the diode 56 and the current may flow through the gallium nitride power device 59A through switching of the gallium nitride power device 59A, causing the current to flow through the heater 20 via the inductor 62. The current that has passed through the heater 20 may be returned to the commercial AC power supply 46. At this time, the gallium nitride power device 59B may be turned on in response to turning-off of the gallium nitride power device 59A, and a reflux current flowing through the inductor 62 may be supplied to the commercial AC power supply 46 through the gallium nitride power device 59B. The reflux current may be supplied to the commercial AC power supply 46 through the gallium nitride power device 59D that is maintained at on state, in this half period. In contrast, in the half period in which the input AC voltage is negative, the current may flow through the diode 57 and the current may flow through the gallium nitride power device 59B through switching of the gallium nitride power device 59B, causing the current to flow through the heater 20 while being inverted in the waveform from the current in the half period in which the input AC voltage is positive. At this time, the gallium nitride power device 59A may be turned on in response to turning-off of the gallium nitride power device 59B, and the reflux current flowing through the inductor 62 may be supplied to the commercial AC power supply 46 through the gallium nitride power device 59A. The reflux current may be supplied to the commercial AC power supply 46 through the gallium nitride power device 59C that is maintained at on state, in this half period.

Figure 8:
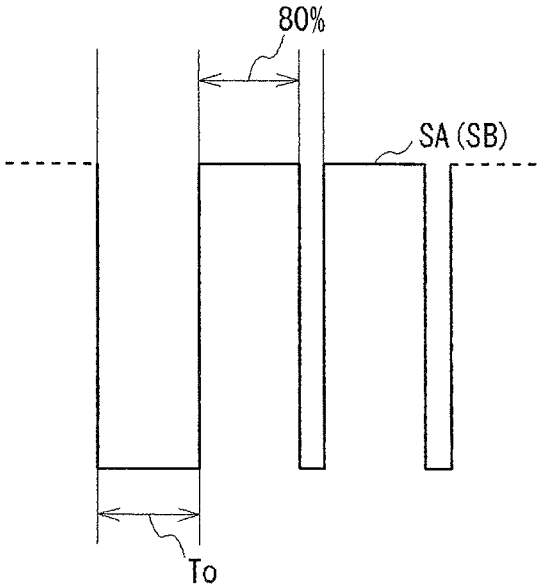
FIG. 8 is a waveform diagram illustrating a duty ratio of a gate signal SA and a gate signal SB and an off time.

The duty ratio at which the gate signals SA and SB are turned on to "H" level, may be set to about 80% as illustrated in FIG. 8. FIG. 8 is an enlarged diagram of a region surrounded by a dashed line in FIG. 6. This causes the power supply section 45 to output, to the heater 20, the output AC voltage effective value of 80 [V] that is an effective value of the output AC voltage when the input AC voltage effective value is 100 [V]. Also, pulse width modulation (PWM) frequencies of the gate signals SA and SB may be about 100 [kHz] to about 200 [kHz]. The controller 48 may provide a predetermined off time as illustrated in FIG. 8, at each zero-cross point of the input AC voltage that is illustrated by a solid line in (A) of FIG. 6, thereby eliminating phase shift. The predetermined off time may be a time period in which the gate signals SA and SB are maintained to off state. As a result, the output AC voltage illustrated by a dashed line in (A) of FIG. 6 may be zero during a period corresponding to the off period before and after each zero-cross point of the input AC voltage.

The gate signals SA and SB may be inverted from each other in order to allow the reflux current of the inductor 62 to flow. The predetermined dead time may be provided at a switch point of the logic level in order to prevent the through current from flowing, as with the above-described gate signals SC and SD. In the power supply section 45, the switching frequency may be set to 100 [kHz] to 200 [kHz] owing to use of the gallium nitride power device. In a case where an insulated gate bipolar transistor (IGBT) or other device is used, the switching frequency may be set to about 20 [kHz] to about 40 [kHz] in consideration of an increase in loss. Also, the current flows between the drain and the source of the gallium nitride power device in both directions when the gate is on. The IGBT may preferably include a body diode or may be coupled in parallel with a diode in order to allow the current to flow in an opposite direction.

The duty ratio of the gate signals SA and SB may be about 80% when the input AC voltage effective value is 100 [V] and the rated input voltage value of the heater 20 is 80 [V] (that is, the output AC voltage effective value is 80 [V]). However, the heater 20 that may be a halogen heater has a low resistance value in an un-warmed up time that is initial energization time. Thus, when the output AC voltage effective value of 80 [V] is applied as an application initial voltage to the heater 20, a large rush current of several tens [A] may flow through the heater 20. To address this, the controller 48 may take a time of 0.5 to 1 second to gradually increase the duty ratio from 20% to 80% in making transition to the printing operation state to perform the heater driving processing that suppresses the rush current.

Figure 9:
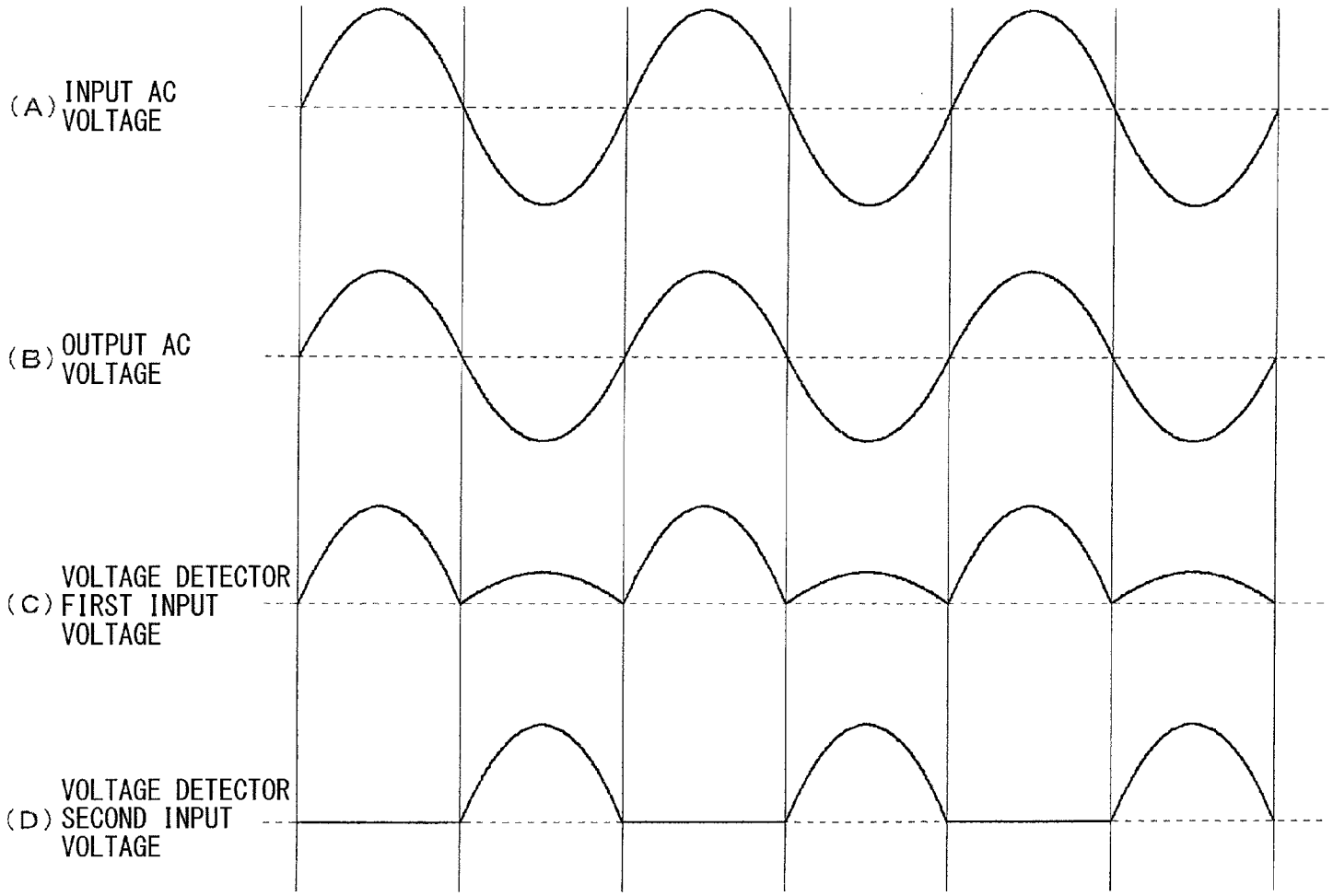
FIG. 9 is a timing chart illustrating an input AC voltage, an output AC voltage, a voltage detector first input voltage, and a voltage detector second input voltage.

(C) of FIG. 9 illustrates a voltage waveform of a voltage detector first input voltage that is supplied to a first voltage detection input terminal 64A of the output voltage detector 64. (D) of FIG. 9 illustrates a voltage waveform of a voltage detector second input voltage that is supplied to a second voltage detection input terminal 64B of the output voltage detector 64. The output voltage detector 64 may be a circuit that calculates an absolute value of a difference between voltages supplied from two lines, and provide the controller 48 with a differential voltage that has been stepped down to a predetermined ratio. The controller 48 performs AD conversion on the voltage supplied from the output voltage detector 64, thereby detecting the heater AC voltage ((B) of FIG. 9) to be applied to the heater 20. At this time, when the input AC voltage ((A) of FIG. 9) having the input AC voltage effective value of 100 [V] is subjected to switching at the duty ratio of 80%, the output AC voltage effective value of 80 [V] may be outputted in theory. However, the loss of the full-bridge circuit 60 may be varied by the current flowing through the heater 20. Thus, the controller 48 performs feedback control in order to increase or decrease the duty ratio, on the basis of the detected heater AC voltage value. More specifically, the controller 48 decreases the duty ratio when the heater AC voltage is higher than the target voltage of 80 [V], whereas the controller 48 increases the duty ratio when the heater AC voltage is smaller than the target voltage of 80 [V]. The controller 48 thus stably applies the output AC voltage of 80 [V] to the heater 20. Also, when the input AC voltage effective value of the input AC voltage is 230 [V], the duty ratio may become about 35%. In this case, the controller 48 decreases, to 35/80, the variation rate of the duty ratio that is increased from 20% to 80% when the input AC voltage is 100 [V], thereby increasing the duty ratio from 8.75% to about 35%.

[1-4. Heater Driving Processing]

Figure 10:
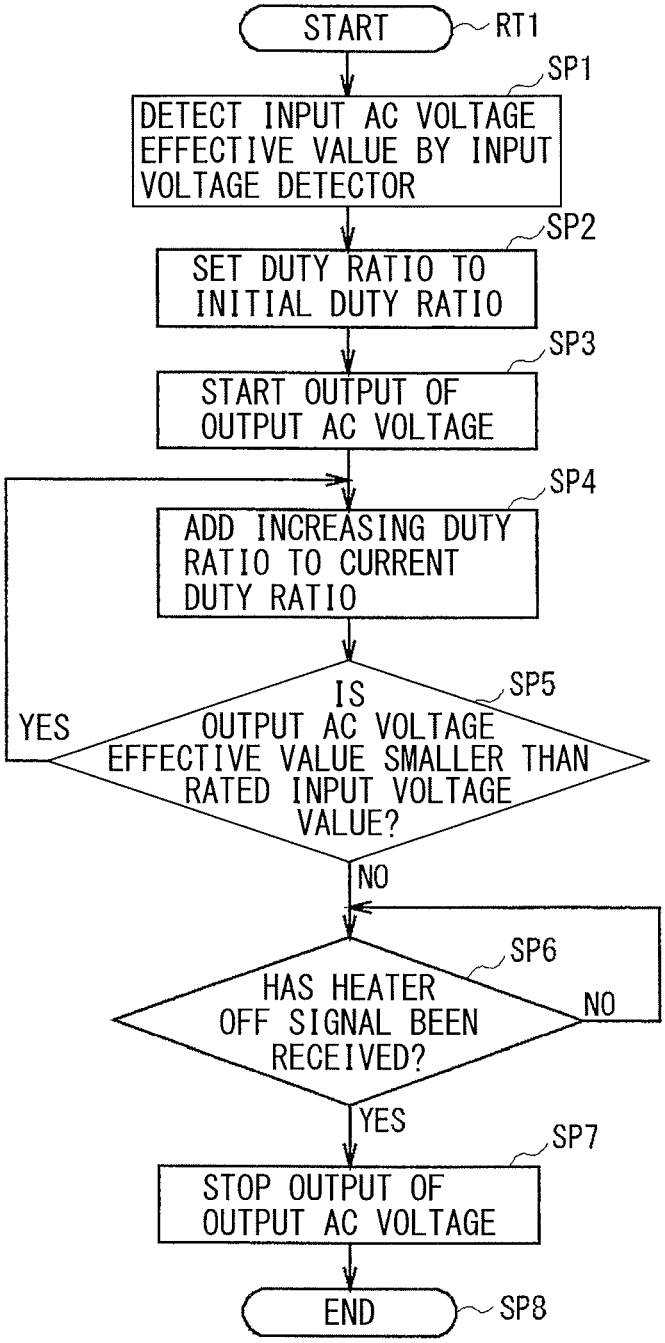
FIG. 10 is a flowchart illustrating a heater driving processing procedure according to the first embodiment.

A specific processing procedure of the heater driving processing performed by the power supply section 45 in the color printer 1 is described with reference to a flowchart of FIG. 10. The controller 48 reads out a heater driving processing program from a memory to execute the program, thereby starting a heater driving processing procedure RT1 and making a transition to step SP1.

In step SP1, the controller 48 acquires the input AC voltage effective value through the input voltage detector 53 to determine whether the commercial AC power supply 46 is of 100 V system or 200 V system. Thereafter, the process proceeds to step SP2. In step SP2, the controller 48 sets the duty ratio to 20% (in a case of 100 V system) or 8.75% (in a case of 200 V system) that is an initial duty ratio, thereby setting the initial output AC voltage to 20% or 8.75% of the input AC voltage. Thereafter, the process proceeds to step SP3. Thus, when the input AC voltage effective value is 100 [V], the output AC voltage effective value may become 20 [V]. When the input AC voltage effective value is 230 [V], the output AC voltage effective value may become 20 [V]. In step SP3, the controller 48 outputs the gate signals SA, SB, SC, and SD that are illustrated in FIG. 6, thereby starting output of the output AC voltage at the zero-cross timing of the input AC voltage. Thereafter, the process proceeds to step SP4.

In step SP4, the controller 48 adds an increasing duty ratio to the current duty ratio, thereby increasing the output AC voltage effective value from the current value. Thereafter, the process proceeds to step SP5. The increasing duty ratio may be determined by the calculation: 0.01×the rated input voltage value/the input AC voltage effective value. For example, when the input AC voltage effective value is 100 [V] and the rated input voltage value of the heater 20 is 80 [V], the increasing duty ratio may become 0.8%. When the input AC voltage effective value is 230 [V] and the rated input voltage value of the heater 20 is 80 [V], the increasing duty ratio may become about 0.35%.

In step SP5, the controller 48 determines whether the current output AC voltage effective value is smaller than the rated input voltage value (80 [V]). When an affirmative result is obtained, the result represents that the output AC voltage effective value that is gradually increased has not been reached the rated input voltage value. At this time, the process returns to step SP4, and the controller 48 further adds the increasing duty ratio to the current duty ratio. As mentioned above, the controller 48 gradually increases the duty ratio from 20% as the initial duty ratio by 0.8% as the increasing duty ratio when the input AC voltage effective value is 100 [V]. The controller 48 gradually increases the duty ratio from 20% or 8.75% as the initial duty ratio by 0.35% as the increasing duty ratio when the input AC voltage effective value is 230 [V]. In this way, the controller 48 performs voltage variable control to gradually increase the output AC voltage effective value.

When the output AC voltage effective value has been reached the rated input voltage value, the controller 48 obtains a denial result in step SP5, and the process thereafter proceeds to step SP6. At this time, when the input AC voltage effective value is 100 [V], the duty ratio becomes 80% that is the target duty ratio, and when the input AC voltage effective value is 230 [V], the duty ratio becomes about 35% that is the target duty ratio. Thereafter, the controller 48 performs, on the basis of the output AC voltage effective value, the feedback control to increase or decrease the duty ratio, thereby maintaining the output AC voltage effective value at the rated input voltage value. At this time, even when the input AC voltage value is temporarily decreased and it is thus necessary to increase the duty ratio to be higher than the target duty ratio, the controller 48 prevents the duty ratio from being increased to 100% to protect the AC-AC converter 38.

In step S6, the controller 48 waits until the heater-off signal is provided from the printer engine controller 32. When the controller 48 receives the heater-off signal, the process proceeds to step SP7. In step SP7, the controller 48 outputs the gate signals SA, SB, SC, and SD illustrated in FIG. 5, to stop output of the output AC voltage. Thereafter, the process proceeds to step SP8 to complete the heater driving processing.

[1-5. Effects, etc.]

In the above-described configuration, the color printer 1 steps down the commercial AC voltage of the commercial AC power supply 46 by the AC-AC converter 38 to generate the heater AC voltage, and supplies the heater AC voltage to the heater 20 of the fixing unit 12. This makes it possible for the color printer 1 possible to use the same heater irrespective of the voltage of the commercial AC power supply 46. Also, in particular, in a case where a halogen heater is used as the heater 20, the halogen heater may involve difficulty in establishing a halogen cycle if the halogen heater is continuously supplied with the voltage smaller than the rated input voltage value, which decreases the lifetime of the halogen heater. The lifetime of the halogen heater decreases even when the halogen heater is supplied with the voltage higher than the rated input voltage value. In contrast, in the color printer 1, the commercial AC voltage is stepped down by the AC-AC converter 38 to generate the heater AC voltage. This makes it possible to drive the heater 20 with the stable heater AC voltage even when the commercial AC voltage is varied, thereby preventing the decrease in lifetime of the heater 20 caused by the variation of the heater AC voltage.

Further, in an existing case where a halogen heater is used in a printer having a small width, for example, equal to or smaller than a medium width of A5 size, it is necessary to wind a filament a large number of times with a small length in order to increase the resistance value. It is thus difficult to create a heater corresponding to a high commercial AC voltage such as 230 [V] with narrow width. In contrast, the color printer 1 steps down the commercial AC voltage by the AC-AC converter 38, and applies the stepped-down heater AC voltage to the heater 20. This makes it possible to decrease the rated input voltage value of the heater 20 that is a halogen heater. Thus, the color printer 1 allows for the use of a halogen heater with a narrow width.

Also, when controlling the duty ratio of the gate signals SA and SB to make the transition to the printing operation state, the color printer 1 gradually increases the duty ratio, thereby gradually increasing the heater AC voltage. This allows the color printer 1 to suppress the rush current to the heater 20. The heater 20 that may be the halogen heater is rapidly cooled when the application of the heater AC voltage is stopped, and the resistance value thereof is gradually decreased. Thus, when the heater AC voltage is applied to the heater 20 again, the rush current easily flows through the heater 20. As mentioned above, the halogen heater has a tendency in which the rush current flows easily in the printing operation upon the use of the color printer 1. Therefore, the color printer 1 that may use a halogen heater as the heater 20 achieves an effect of preventing the rush current remarkably owing to the control of the duty ratio.

Further, in the case where the phase of the commercial AC voltage is controlled by a triac as with an existing color printer, the waveform of the commercial AC voltage and the waveform of the heater AC voltage are not similarly to each other. Thus, the power factor tends to be decreased. In contrast, the color printer 1 controls the duty ratio of the commercial AC voltage to generate the heater AC voltage in synchronization with the zero-cross timing of the commercial AC voltage, without involving the phase control of the commercial AC voltage. Thus, the color printer 1 makes the waveform of the heater AC voltage similar to the waveform of the commercial AC voltage, which improves the power factor.

Also, the color printer 1 may sets the initial duty ratio to 20% instead of setting the initial duty ratio to 0%. This allows the color printer 1 to rapidly heat the heater 20 within a range in which the rush current does not cause problem in a practical use.

Also, in the color printer 1, a part of the full-wave rectification circuit that rectifies the commercial AC voltage in synchronization with the power supply cycle may be shared with the full-bridge circuit 60 that performs switching to step down the commercial AC voltage. This makes it possible to decrease the number of members of the color printer 1.

According to the above-described configuration, the color printer 1 according to one embodiment includes: the input voltage detector 53 that detects the power supply voltage value of the commercial AC voltage that is within a predetermined input AC voltage range supplied from the commercial AC power supply 46; the zero-cross detector 54 that detects the power supply cycle of the commercial AC voltage; the AC-AC converter 38 that performs switching of the commercial AC voltage and thereby converts the commercial AC voltage into the heater AC voltage, in which the heater AC voltage is the AC voltage to be applied to the heater 20 provided in the fixing unit 12 that heats the print medium P, and the heater 20 has the rated input voltage value that is smaller than a lower limit of the input AC voltage range of the commercial AC power supply 46; and the controller 48 that controls the AC-AC converter 38 to generate the heater AC voltage, on the basis of the power supply voltage value detected by the input voltage detector 53 and the power supply cycle detected by the zero-cross detector 54, in which the heater AC voltage is stepped down from the effective value of the commercial AC voltage and is synchronized with the power supply cycle. Hence, it is possible for the color printer 1 to use the same heater irrespective of the commercial AC voltage of the commercial AC power supply 46. Thus, even when a change is made to the commercial AC power supply 46, it is possible to couple the color printer to the changed commercial AC power supply 46 and to continuously use the color printer without introducing another color printer.

According to an embodiment of the invention, it is therefore possible to achieve an image forming apparatus that makes it possible to use the same fixing unit irrespective of a commercial AC voltage of a commercial AC power supply, and thereby to improve functionality.

2. Second Embodiment

[2-1. Internal Configuration of Color Printer]

Figure 11:
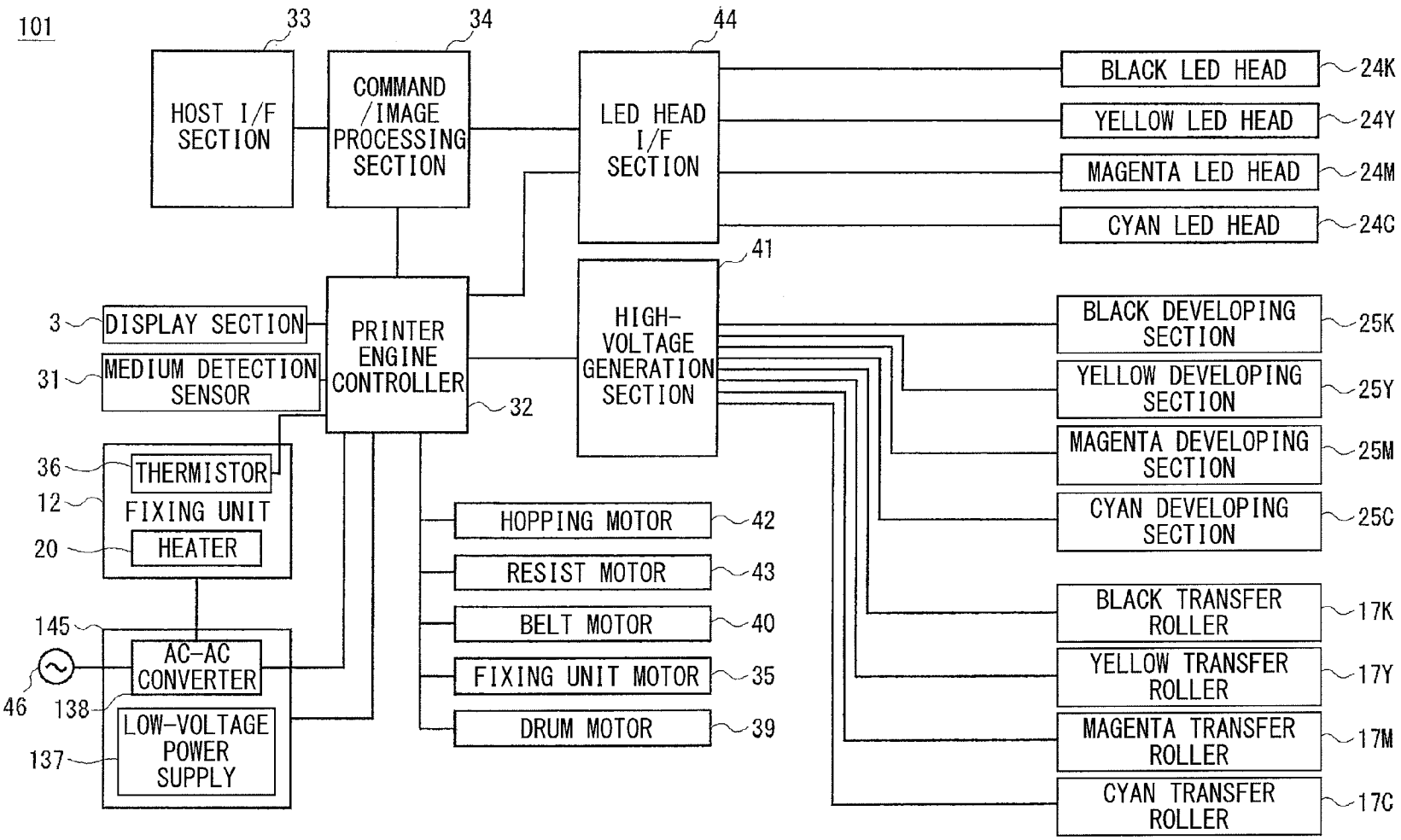
FIG. 11 is a block diagram illustrating a circuit configuration of a color printer according to a second embodiment.

As illustrated in FIG. 1 and FIG. 11 in which the same reference numerals are attached to members corresponding to those of FIG. 2, a color printer 101 according to a second embodiment has a configuration similar to that of the color printer 1 according to the first embodiment except that the power supply section 45 is replaced with a power supply section 145. The power supply section 145 includes a low-voltage power supply 137.

[2-2. Circuit Configuration of Power Supply Section]

Figure 12:
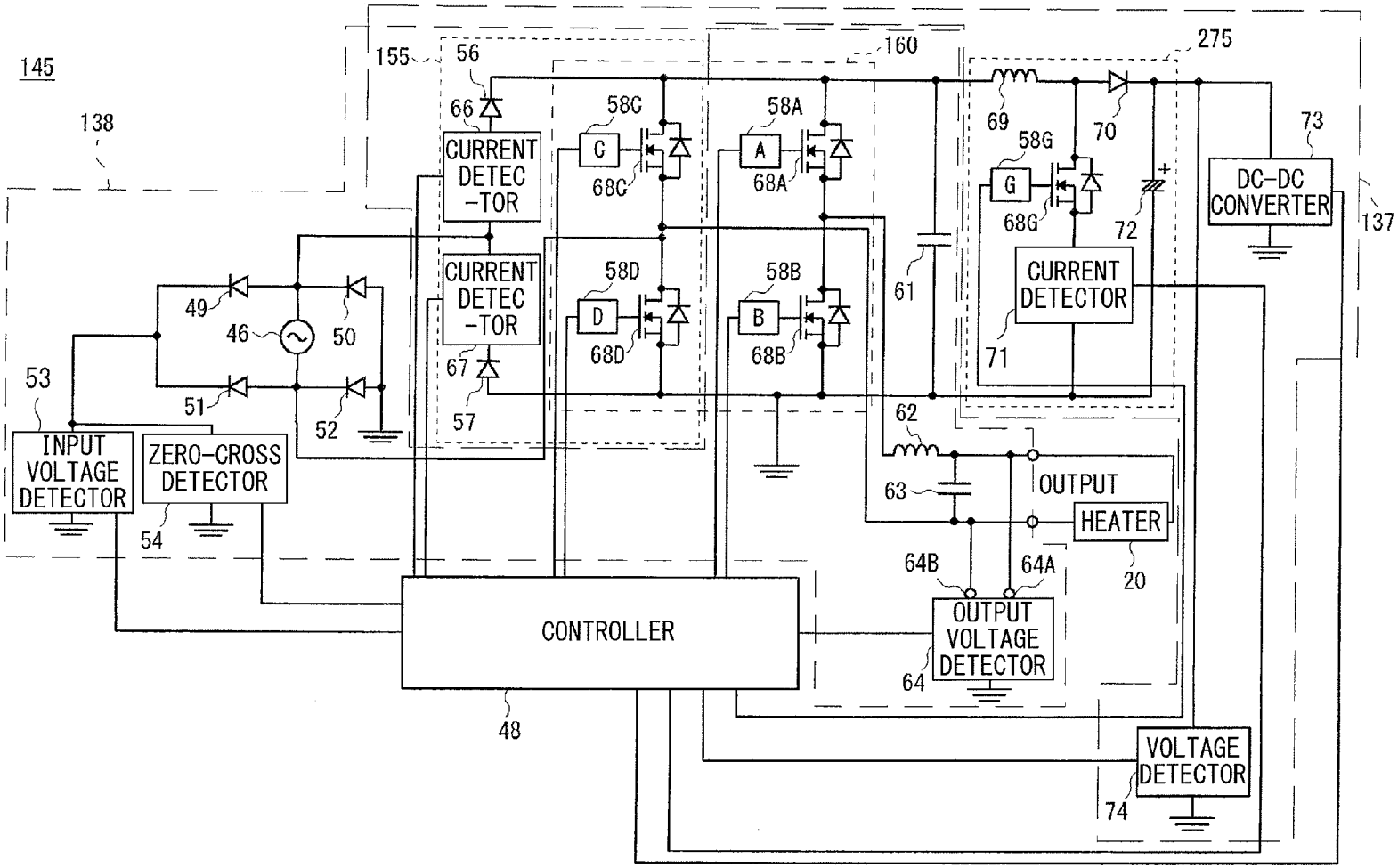
FIG. 12 is a block diagram illustrating a circuit configuration of a power supply section according to the second embodiment.

As illustrated in FIG. 12 in which the same reference numerals are attached to members corresponding to those of FIG. 3, the power supply section 145 may be different from the power supply section 45 in that the AC-AC converter 38 is replaced with the AC-AC converter 138, and the low-voltage power supply 137 is included. The AC-AC converter 138 may be different from the AC-AC converter 38 in that the full-wave rectification circuit 55 is replaced with a full-wave rectification circuit 155, and in that a booster circuit 275 is included. Also, the power supply section 45 includes field effect transistors (FETs) 68A, 68B, 68C, and 68D, in place of the gallium nitride power devices 59A, 59B, 59C, and 59D that are switching devices of the power supply section 45. Each of the FETs includes a reflux body diode.

When the commercial AC voltage is applied as the input AC voltage, a full-wave rectified voltage may be generated at both ends of the capacitor 61 by the diodes 56 and 57 and the incorporated diodes of the FETs 68C and 68D. Subsequently, the current flowing through the diode 70 through the inductor 69 may be charged at an electrolytic capacitor 72, and a rectified voltage may be accordingly generated at both ends of the electrolytic capacitor 72. A DC-DC converter 73 generates a voltage to be supplied to the controller 48.

Thereafter, the controller 48 drives a gate drive circuit 58G at a predetermined switching frequency from the zero-cross timing, in synchronization with the zero-cross detection signal S2 of the zero-cross detector 54. More specifically, the controller 48 controls the duty ratio of the gate signal that drives the gate drive circuit 58G, on the basis of the current value detected by a current detector 71 configured of, for example, a resistor, and a voltage value detected by a voltage detector 74. Then, the controller 48 adjusts driving of the gate drive circuit 58G to allow the voltage detected by the voltage detector 74 to be a predetermined voltage, for example, DC 390 [V]. A power factor correction booster circuit as a power factor correction (PFC) circuit may be configured by the controller 48, the voltage detector 74, and the booster circuit 275, and the power factor correction booster circuit may operate in a continuous mode. The DC-DC converter 73 may be configured of a switching power supply using, for example, a transformer. When the input voltage varies to DC 390 [V] that is boosted from a capacitor input rectified voltage of the initial state, the DC-DC converter 73 operates a circuit outputting a voltage of 24 V that is a high voltage necessary for operation of the color printer 1.

Each of current detectors 66 and 67 may be configured by a current transformer. Each of the current detectors 66 and 67 converts the current into a voltage by causing a current, equivalent to the current flowing through the diode 56 and equivalent to the current flowing through the diode 57, to flow through primary side of the transformer, and by causing a current that is decreased by means of a turn ratio to flow through a resistor on secondary side of the transformer. A turn ratio of the primary side to the secondary side of the transformer may be of about 1 to 200, in each of the current detectors 66 and 67. Thus, the current detectors 66 and 67 each detect the output AC current as the heater AC current to be fed to the heater 20, and supply the detection result to the controller 48 as the heater AC current value. The controller 48 uses the result that is obtained as a result of the addition of the detection values of both the current detectors 66 and 67 to each other, in consideration of the output AC current that alternately flows through the current detectors 66 and 67 for each half period. The output current value may not only include the current to be supplied to the heater 20 but also include the current flowing through the booster circuit 275 and other members. Thus, the controller 48 is allowed to detect the total current consumed by the color printer 101 with use of the current detectors 66 and 67.

As mentioned above, the color printer 1 may perform the heater driving processing that takes 0.5 to 1 second to increase the duty ratio of the AC-AC converter 38 from 20% to 80% in the case where the input AC voltage effective value is 100 [V]. In the case where the input AC voltage effective value is 230 [V], the color printer 1 may perform the heater driving processing that takes 0.5 to 1 second to increase the duty ratio of the AC-AC converter 38 from 8.75% to 35%. In contrast, the color printer 101 may perform the heater driving processing that varies the duty ratio in accordance with the current values detected by the respective current detectors 66 and 67 may be performed. For example, in a case of using the heater 20 that has the rated input voltage value of 80 [V] and the rated power consumption value of 1200 [W], the current of 15 [A] may flow through the heater 20 when the voltage of 80 [V] is applied. Further, the resistance value of the heater 20 may be low and the rush current may flow in the initial energization of the halogen heater. Thus, the color printer 101 increases the heater AC voltage with use of the output AC voltage effective value of 15 [A] as the current upper limit value, when the input AC voltage effective value is 100 [V].

[2-3. Heater Driving Processing]

Figure 13:
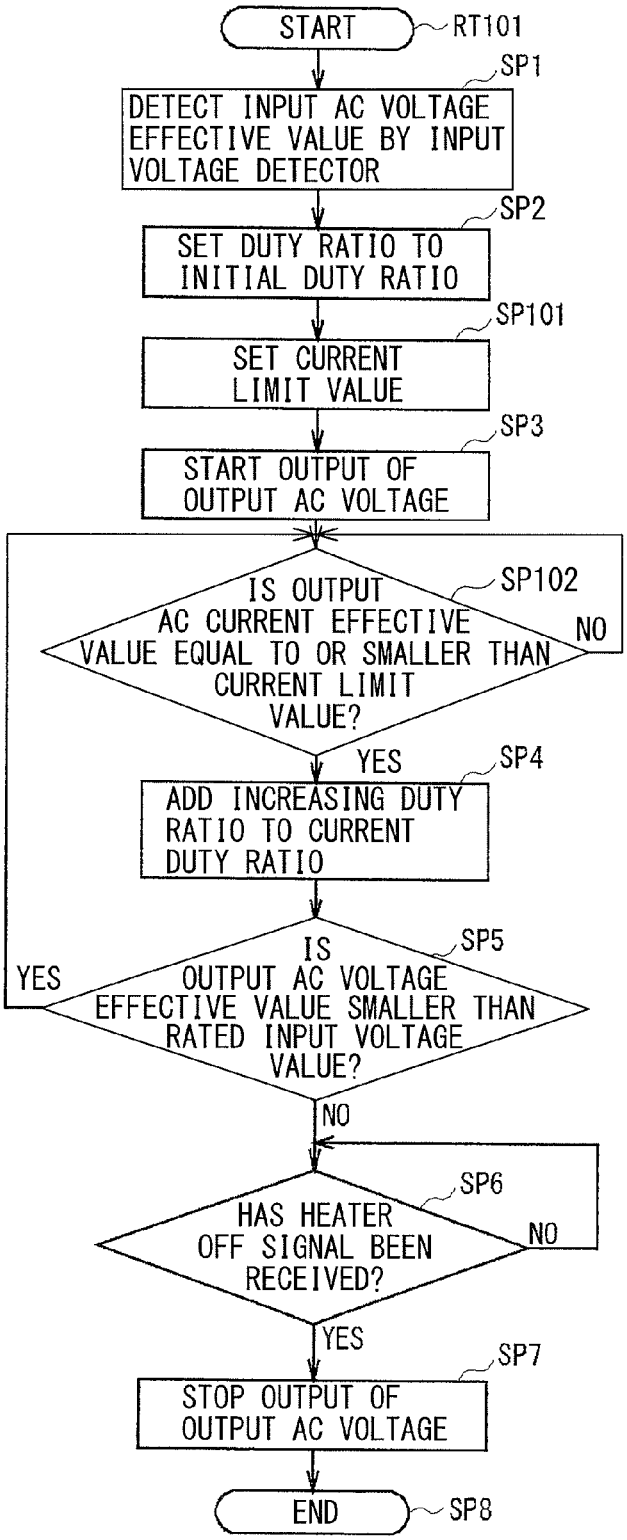
FIG. 13 is a flowchart illustrating a heater driving processing procedure according to the second embodiment.

A specific processing procedure of the heater driving processing by the power supply section 145 in the color printer 101 is described with reference to the flowchart of FIG. 13 in which the same reference numerals are attached to steps corresponding to those of FIG. 10. The controller 48 reads out a heater driving processing program from a memory and executes the program, thereby starting a heater driving processing procedure RT101 to make a transition to step SP1. In the heater driving processing procedure RT101, steps SP101 and SP102 may be added, as compared with the heater driving processing procedure RT1 (FIG. 10).

In step SP101 after steps SP1 and SP2, the controller 48 sets the current limit value to a value that is defined as 15×100/the input AC voltage effective value. Thereafter, the process proceeds to step SP3. As a result, the current limit value may become 15 [A] when the input AC voltage effective value is 100 [V], and the current limit value may become 7.5 [A] when the input AC voltage effective value is 200 [V]. Here, the current value in a case where the power consumption value is limited to 1500 [W] may be calculated.

In step S102 after step SP3, the controller 48 determines whether the output AC current effective value is equal to or smaller than the current limit value. When a denial result is obtained, the result represents that the output AC voltage is not to be increased from the current value in view of a large rush current that may flow through the heater 20. In this case, in step SP102, the controller 48 waits until the output AC current effective value becomes equal to or smaller than the current limit value. In contrast, when an affirmative result is obtained in step SP102, the result represents that the output AC voltage is to be increased from the current value in view of no possibility of a large rush current that may flow through the heater 20. In this case, the process proceeds to step SP4, and the controller 48 thereafter performs processes similar to those in the heater driving processing procedure RT1.

In this way, the color printer 101 detects the output AC current effective value. When the output AC current effective value exceeds the current limit value, the color printer 101 prevents the output AC voltage effective value from being increased from the current value. When the output AC current effective value is equal to or smaller than the current limit value, the color printer 101 gradually increases the output AC voltage effective value. Hence, it makes it possible for the color printer 101 to ensure even more that the rush current is prevented from flowing through the heater 20 as compared with the color printer 1. In addition, the color printer 101 exerts action and effects similar to those of the color printer 1.

3. Third Embodiment

[3-1. Internal Configuration of Color Printer]

As illustrated in FIG. 1, a color printer 201 according to a third embodiment has a configuration similar to that of the color printer 1 according to the first embodiment, except that the power supply section 45 is replaced with a power supply section 245.

[3-2. Circuit Configuration of Power Supply Section]

Figure 14:
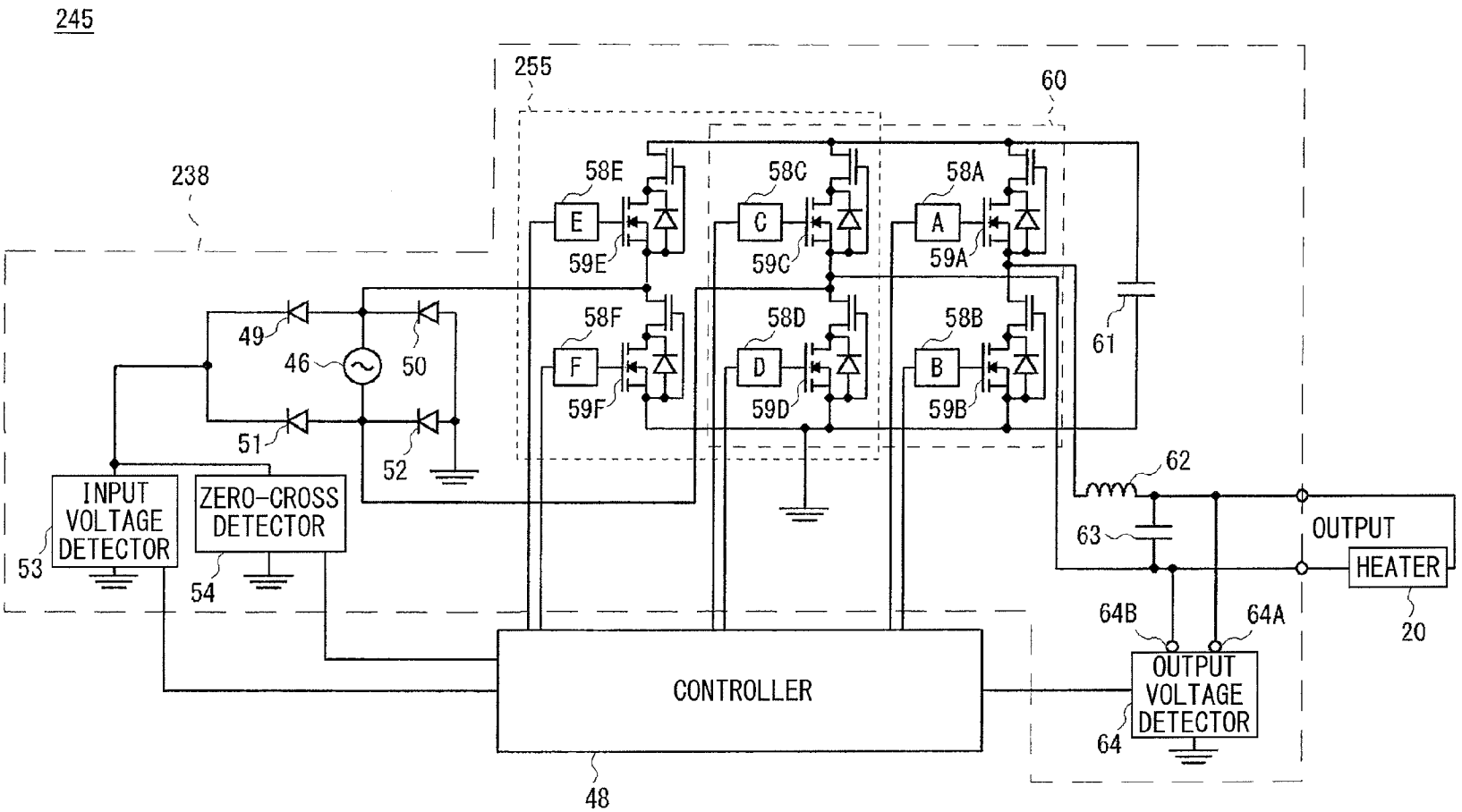
FIG. 14 is a block diagram illustrating a circuit configuration of a power supply section according to a third embodiment.

As illustrated in FIG. 14 in which the same reference numerals are attached to members corresponding to those of FIG. 3, the power supply section 245 may be different from the power supply section 45 in that the AC-AC converter 38 is replaced with an AC-AC converter 238. The AC-AC converter 238 has a configuration similar to that of the AC-AC converter 38 except that the full-wave rectification circuit 55 is replaced with a full-wave rectification circuit 255. The full-wave rectification circuit 255 includes a gate drive circuit 58E and a gallium nitride power device 59E in place of the diode 56 of the full-wave rectification circuit 55, and includes a gate drive circuit 58F and a gallium nitride power device 59F in place of the diode 57.

In the power supply section 245, the on voltage between the drain and the source of each of the gallium nitride power devices 59E and 59F may become sufficiently smaller than a forward voltage of each of the diodes 56 and 57 in the power supply section 45. Thus, the power supply section 245 improves efficiency as compared with the power supply section 45. In addition, the color printer 201 exerts action and effects similar to those of the color printer 1.

4. Fourth Embodiment

[4-1. Internal Configuration of Color Printer]

Figure 15:
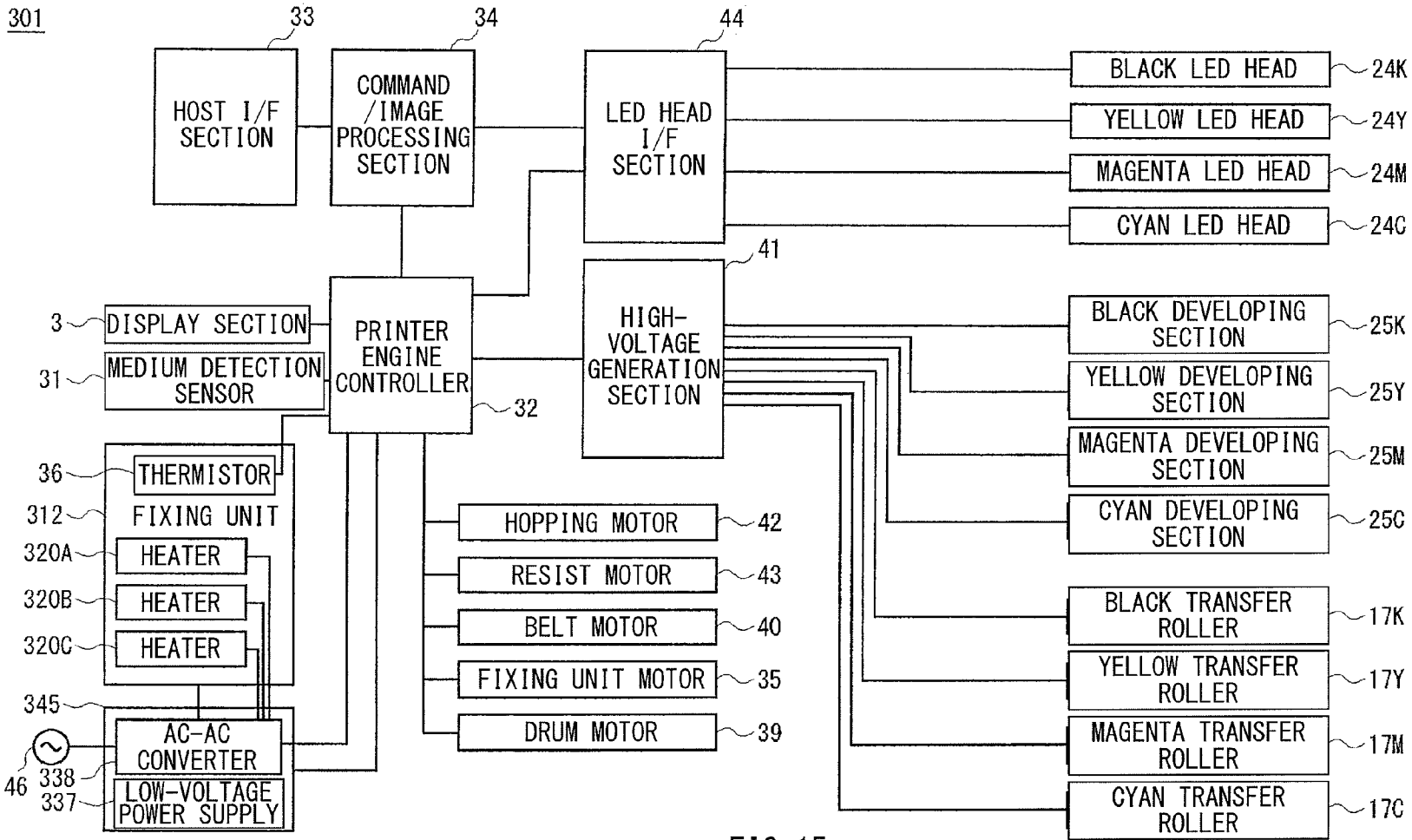
FIG. 15 is a block diagram illustrating a circuit configuration of a color printer according to a fourth embodiment.
Figure 16:
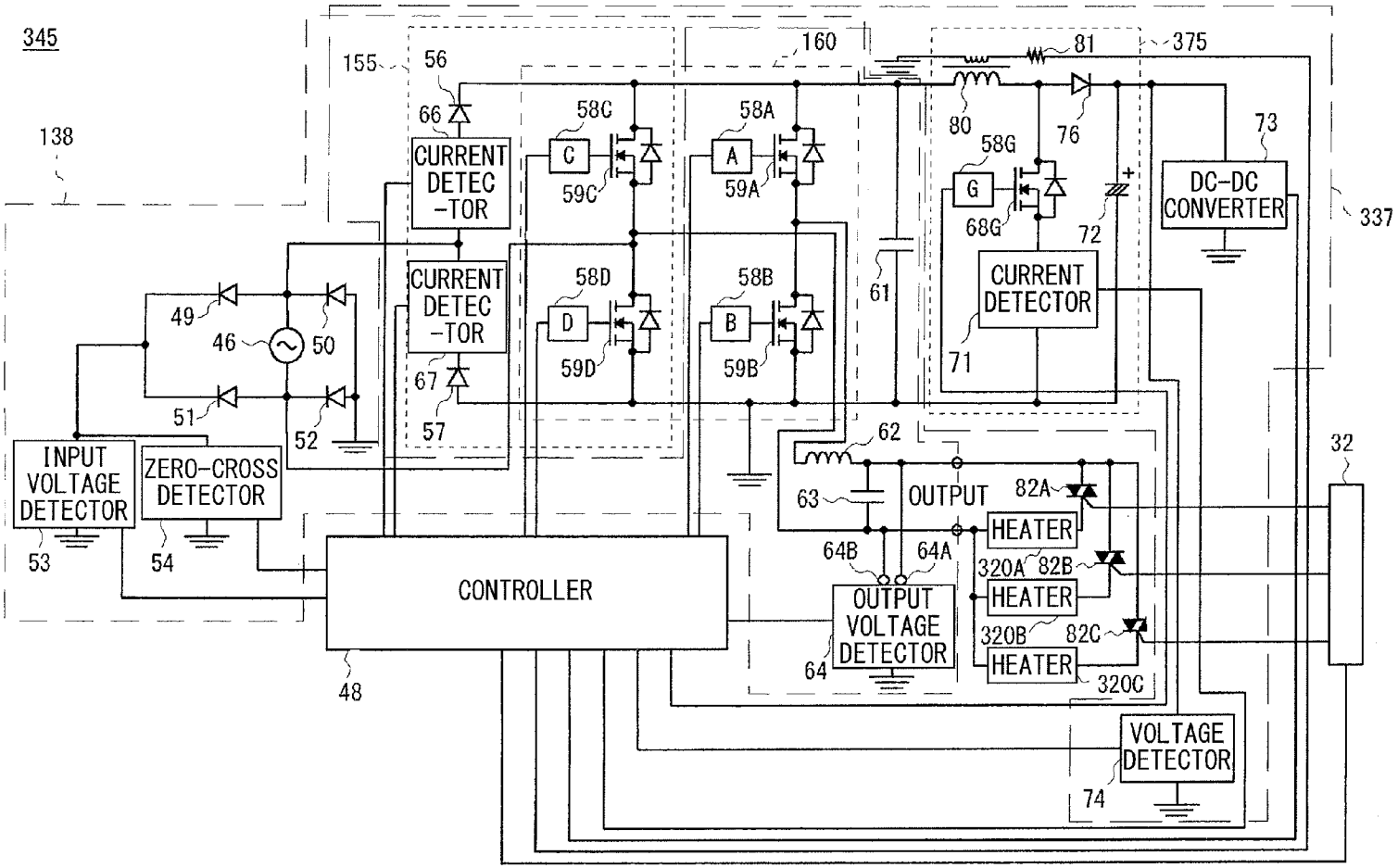
FIG. 16 is a block diagram illustrating a circuit configuration of a power supply section according to the fourth embodiment.

As illustrated in FIG. 1, and FIGS. 15 and 16 in which the same reference numerals are attached to members corresponding to those of FIGS. 11 and 12, a color printer 301 according to a fourth embodiment has a configuration similar to that of the color printer 101 according to the second embodiment, except that the power supply section 145 is replaced with a power supply section 345, and the fixing unit 12 is replaced with a fixing unit 312. The fixing unit 312 includes three heaters 320A, 320B, and 320C, whereas the fixing unit 12 has one heater 20.

[4-2. Circuit Configuration of Power Supply Section]

As illustrated in FIG. 16, the power supply section 345 has a configuration similar to that of the power supply section 145 except that the low-voltage power supply 137 (FIG. 12) is replaced with a low-voltage power supply 337. The low-voltage power supply 337 may be different from the low-voltage power supply 137 in that the booster circuit 275 is replaced with a booster circuit 375. The booster circuit 375 may be different from the booster circuit 275 in that an inductor 80 having an auxiliary winding is provided in place of the inductor 69, and a resistor 81 is added. A power factor correction booster circuit as a PFC circuit may be configured by the controller 48, the voltage detector 74, and the booster circuit 375. The power factor correction booster circuit may operate in a criticality mode. An output of the booster circuit 375 may be provided to the controller 48 through the resistor 81. This causes the voltage of the auxiliary winding of the inductor 80 to vary at timing at which the inductor current becomes zero, namely, at timing at which the FET 68G is turned off to allow the current to flow through the diode 76 and the current becomes zero. Thus, the controller 48 detects an edge of the voltage with use of, for example, a comparator, thereby determining the subsequent on timing of the FET 68G.

Triacs 82A, 82B, and 82C may be respectively coupled to the heaters 320A, 320B, and 320C. Lengths in a width direction of the respective heaters 320A, 320B, and 320C may be made different to address respective medium sizes. One of the three heaters 320A, 320B, and 320C may have a light emitting length equal to or smaller than 10 cm which corresponds to a medium with an extremely narrow width, such as a size of a business card. The energization of the heaters 320A, 320B, and 320C may be switched in accordance with the medium size. Also, mutually-different rated power consumption values may be combined and set for the heaters 320A, 320B, and 320C. The printer engine controller 32 controls the triacs 82A, 82B, and 82C in accordance with the image formation condition, thereby controlling whether to apply the heater AC voltage, for each of the heaters 320A, 320B, and 320C.

The printer engine controller 32 instructs the controller 48 to output the output AC voltage from the AC-AC converter 138, and selects on or off of the triacs 82A, 82B, and 82C. The controller 48 increases, by the AC-AC converter 138, the output AC voltage effective value to the rated input voltage value of 80 [V]. Thereafter, when the output AC current effective value as the feeding current value exceeds the current limit value, the controller 48 notifies the printer engine controller 32 of the situation by means of the output current value limit over signal of L or H level. When the output AC current effective value exceeds the current limit value, the printer engine controller 32 temporarily turns off some of the triacs 82A, 82B, and 82C, thereby performing the heater driving processing to suppress the current flowing through the corresponding heaters 320A, 320B, and 320C.

[4-3. Heater Driving Processing]

Figure 17:
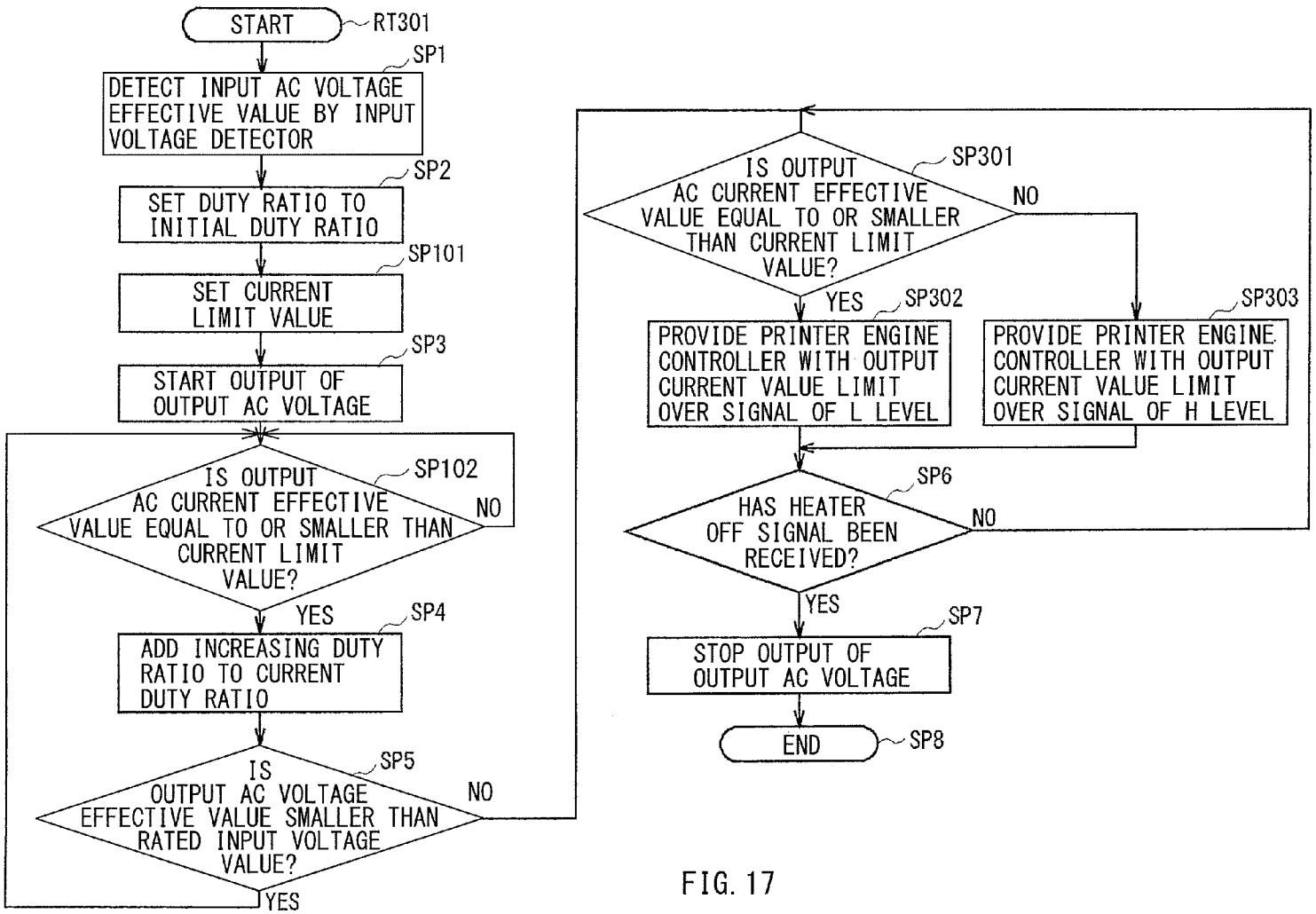
FIG. 17 is a flowchart illustrating a heater driving processing procedure according to the fourth embodiment.

A specific processing procedure of the heater driving processing performed by the power supply section 345 in the color printer 301 is described with reference to a flowchart of FIG. 17 in which the same reference numerals are attached to steps corresponding to those of FIG. 13. The controller 48 reads out a heater driving processing program from a memory and executes the program, thereby starting a heater driving processing procedure RT301 to make a transition to step SP1. In the heater driving processing procedure RT301, steps SP301, SP302, and SP303 may be added, as compared with the heater driving processing procedure RT101 (FIG. 13).

In step SP301 after steps SP1, SP2, SP101, SP3, SP102, SP4, and SP5, the controller 48 determines whether the output AC current effective value is equal to or smaller than the current limit value. When an affirmative result is obtained, the result represents that the current power consumption value of the color printer 301 is equal to or smaller than the rated power consumption value. In this case, the process of the controller 48 proceeds to step SP302. In step SP302, the controller 48 provides the printer engine controller 32 with the output current value limit over signal of L level, following which the process proceeds to step SP6 and the processes similar to those of the heater driving processing procedure RT101 may be performed thereafter. When acquiring the output current value limit over signal of L level, the printer engine controller 32 continuously energizes the currently-energized heater 320.

In contrast, when a denial result is obtained in step SP301, the result represents that the current power consumption value of the color printer 301 exceeds the rated power consumption value. In this case, the process of the controller 48 proceeds to step SP303. In step SP303, the controller 48 provides the printer engine controller 32 with the output current value limit over signal of H level, following which the process proceeds to step SP6 and the processes similar to those of the heater driving processing procedure RT101 may be performed thereafter. When acquiring the output current value limit over signal of H level, the printer engine controller 32 halts energization to a predetermined heater 320 of the currently-energized heaters 320.

Thereafter, when acquiring the output current value limit over signal of L level again, the printer engine controller 32 resumes energization to the heater 320 to which the energization has been halted.

In this way, the color printer 301 continuously detects the output AC current effective value even after the output AC voltage effective value has reached the rated input voltage value. When the output AC current effective value exceeds the current limit value, the color printer 301 halts energization to the predetermined heater 320 out of the heaters 320 that are currently energized. This makes it possible for the color printer 301 to prevent the power consumption value from exceeding the rated power consumption for a long time, and to operate within a power suppliable range.

Also, the color printer 301 continuously detects the output AC current effective value even after the energization to the heater 320 is once stopped. Further, when the output AC current effective value becomes equal to or smaller than the current limit value again, the color printer 301 may resume the energization to the heater 320 to which the energization has been halted. This enables the color printer 301 to heat all of the heaters 320 that are necessary for printing operation within a range in which the power consumption value meets the rated power consumption value. In addition, the color printer 301 exerts action and effects similar to those of the color printer 101.

5. Other Embodiments

As the above-described first embodiment, a description has been given in which an embodiment of the invention is applied to the color printer 1 in which the rated input voltage value of the fixing unit 12 is 80 [V]. An embodiment of the invention, however, is not limited thereto. The example embodiment of the invention may be applied to a color printer in which the rated input voltage value is 70 [V], 90 [V], or any other value. In the color printer 1, the rated input voltage value of the fixing unit 12 is set to 80 [V] in consideration of variation of ±10% with respect to the input voltage effective value of 100 [V] and efficiency of the AC-AC converter 38. Alternatively, the rated input voltage value of the fixing unit may be set to 90 [V], and the input AC voltage may be stepped down to output the output AC voltage having the output AC voltage effective value of 90 [V] when the input AC voltage effective value is equal to or greater than 100 [V]. When the input AC voltage effective value is within a range from 90 [V] to 100 [V], the input AC voltage may be stepped down to output the output AC voltage having the output AC voltage effective value within a range from 81 [V] to 90 [V]. For example, in a printer, the power specification in which the rated current value is 15 [A] and the rated power consumption value is 1500 [W] may often be used in a case of the commercial AC voltage of 100 [V]. In such as case, when the rated input voltage value of the fixing unit is 90 [V] and the input AC voltage effective value is equal to or greater than 100 [V], the input AC voltage may be stepped down to output the output AC voltage having the output AC voltage effective value of 90 [V], or when the input AC voltage effective value is 90 [V], control may be performed to decrease the output by 10%. This decreases the power supply to the heater by 10% even when the input AC voltage effective value is decreased to 90 [V] in the case of the printer having the rated power consumption value of 1500 [W]. Hence, it is possible to suppress the rated current value to be equal to or smaller than 15 [A]. The same is applicable to the second to fourth embodiments.

Further, a description has been given of the above-described fourth embodiment in which the energization of the heater 320 is switched to on or off to suppress the power consumption value within the rated power consumption range in a state in which the output AC voltage effective value is 80 [V]. An embodiment of the invention, however, is not limited thereto. The halogen heater is able to have an application voltage width of about ±10% with respect to the rated input voltage value. Thus, when the output AC current effective value exceeds the current limit value, the duty ratio of the AC-AC converter 138 may be decreased by, for example, 10% to set the output AC voltage effective value to 72 [V], thereby suppressing the power consumption value within the rated power consumption value. In other words, whether the output AC current effective value exceeds the current limit value may be monitored to determine whether the power consumption value is within the rated power consumption range, and the power consumption value may be suppressed when the power consumption value exceeds the rated power consumption value.

Further, a description is given of the above-described fourth embodiment in which the heater having the light emitting length equal to or smaller than 10 cm which corresponds to a medium with an extremely narrow width, such as the size of a business card, is used as one of the three heaters 320. An embodiment of the invention, however, is not limited thereto. For example, in a case of a color printer corresponding to a medium of A3 size, heaters to be used may have various lengths or may be variously arranged, for example, one heater corresponding to A4 size may be disposed at the center in a width direction and one heater may be disposed on each of both sides of the center heater in the width direction.

Further, the current limit value in step SP301 of the heater driving processing procedure RT301 according to the fourth embodiment may be varied in accordance with the input AC voltage effective value. For example, in the case where the input AC voltage effective value is 100 [V], setting the current limit value to 15 [A] makes it possible to control the power consumption value so as not to exceed the rated power consumption value of 1500 [W]. For example, in the case where the input AC voltage effective value is 200 [V], setting the current limit value to 10 [A] makes it possible to control the power consumption value so as not to exceed the rated power consumption value of 2000 [W].

Further, as the example embodiments described above, a description has been given in which an embodiment of the invention is applied to the color printer 1 as a four-color printer. An embodiment of the invention, however, is not limited thereto. Any of embodiments of the invention may be applied to various printers such as a monochrome printer and a five-color printer including a spot color.

Further, a description has been given of the above-described first embodiment in which the color printer 1 includes the input voltage detector 53 serving as the power supply voltage detector, the zero-cross detector 54 serving as the power supply cycle detector, the AC-AC converter 38 serving as the voltage converter, and the controller 48 serving as the controller. Further, the color printer serves as the image forming apparatus. However, an embodiment of the invention is not limited thereto. The image forming apparatus may include a power voltage detector, a power supply cycle detector, a voltage converter, an output voltage detector, and a controller each having any of various configurations.

Furthermore, the invention encompasses any possible combination of some or all of the various embodiments and the modifications described herein and incorporated herein.

It is possible to achieve at least the following configurations from the above-described example embodiments of the invention.

(1) An image forming apparatus, including:

a power supply voltage detector that detects a power supply voltage value of a commercial alternating-current voltage that is within a predetermined input alternating-current voltage range, the commercial alternating-current voltage being supplied from a commercial alternating-current power supply;

a power supply cycle detector that detects a power supply cycle of the commercial alternating-current voltage;

a voltage converter that performs switching of the commercial alternating-current voltage, and thereby converts the commercial alternating-current voltage into a heater alternating-current voltage to be applied to a heater, the heater being provided in a fixing unit that heats a medium; and a controller that controls the voltage converter and thereby generates the heater alternating-current voltage, on a basis of the power supply voltage value detected by the power supply voltage detector and the power supply cycle detected by the power supply cycle detector, the heater alternating-current voltage having an effective value that is stepped down from an effective value of the commercial alternating-current voltage, and being synchronized with the power supply cycle.

(2) The image forming apparatus according to (1), wherein the heater has a rated input voltage value that is smaller than a lower limit of the input alternating-current voltage range of the commercial alternating-current power supply.

(3) The image forming apparatus according to (2), wherein, upon starting printing operation, the controller gradually increases a heater alternating-current voltage value that is a voltage value of the heater alternating-current voltage.

(4) The image forming apparatus according to (3), wherein the controller gradually increases a duty ratio of the switching performed by the voltage converter.

(5) The image forming apparatus according to (4), further including a current detector that detects a heater alternating-current current value of a heater alternating-current current flowing through the heater, wherein the controller causes the voltage converter to suspend the increasing of the duty ratio when the heater alternating-current current value exceeds a predetermined current limit value.

(6) The image forming apparatus according to (5), wherein the controller decreases the heater alternating-current voltage value by causing the voltage converter to suspend the increasing of the duty ratio.

(7) The image forming apparatus according to (4), further including an output voltage detector that detects the heater alternating-current voltage value, wherein the controller gradually increases the duty ratio until the heater alternating-current voltage value reaches the rated input voltage value of the heater.

(8) The image forming apparatus according to (7), further including a current detector that detects a supply current value that is a current value of a current to be supplied to the image forming apparatus, wherein the controller regulates power to be applied to the heater when the supply current value exceeds a predetermined current limit value.

(9) The image forming apparatus according to (8), wherein the heater includes a plurality of heaters, and the controller halts energization performed on a predetermined heater out of the plurality of heaters when the supply current value exceeds the current limit value.

(10) The image forming apparatus according to (9), wherein the controller resumes the energization of the predetermined energization-halted heater when the supply current value becomes equal to or smaller than the current limit value.

(11) The image forming apparatus according to (8), wherein the controller decreases the duty ratio when the supply current value exceeds the current limit value.

(12) The image forming apparatus according to (3), wherein the heater is a halogen heater.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus, comprising:

a power supply voltage detector that detects a power supply voltage value of a commercial alternating-current voltage that is within a predetermined input alternating-current voltage range, the commercial alternating-current voltage being supplied from a commercial alternating-current power supply;

a power supply cycle detector that detects a power supply cycle of the commercial alternating-current voltage;

a voltage converter that performs switching of the commercial alternating-current voltage, and thereby converts the commercial alternating-current voltage into a heater alternating-current voltage to be applied to a heater, the heater being provided in a fixing unit that heats a medium; and a controller that controls the voltage converter and thereby generates the heater alternating-current voltage, on a basis of the power supply voltage value detected by the power supply voltage detector and the power supply cycle detected by the power supply cycle detector, the controller gradually increasing the heater alternating-current voltage upon starting a printing operation of the image forming apparatus, the heater alternating-current voltage having an effective value that is stepped down from an effective value of the commercial alternating-current voltage, and being synchronized with the power supply cycle.

2. The image forming apparatus according to claim 1, wherein the heater has a rated input voltage value that is smaller than a lower limit of the input alternating-current voltage range of the commercial alternating-current power supply.

3. The image forming apparatus according to claim 1, wherein the controller gradually increases a duty ratio of the switching performed by the voltage converter.

4. The image forming apparatus according to claim 3, further comprising a current detector that detects a heater alternating-current current value of a heater alternating-current current flowing through the heater, wherein the controller causes the voltage converter to suspend the increasing of the duty ratio when the heater alternating-current current value exceeds a predetermined current limit value.

5. The image forming apparatus according to claim 4, wherein the controller decreases the heater alternating-current current value by causing the voltage converter to suspend the increasing of the duty ratio.

6. The image forming apparatus according to claim 3, further comprising an output voltage detector that detects a heater alternating-current voltage value of the heater alternating-current voltage, wherein the controller gradually increases the duty ratio until the heater alternating-current voltage value reaches the rated input voltage value of the heater.

7. The image forming apparatus according to claim 6, further comprising a current detector that detects a supply current value that is a current value of a current to be supplied to the image forming apparatus, wherein the controller regulates power to be applied to the heater when the supply current value exceeds a predetermined current limit value.

8. The image forming apparatus according to claim 7, wherein the heater comprises a plurality of heaters, and the controller halts energization performed on a predetermined heater out of the plurality of heaters when the supply current value exceeds the current limit value.

9. The image forming apparatus according to claim 8, wherein the controller resumes the energization of the predetermined energization-halted heater when the supply current value becomes equal to or smaller than the current limit value.

10. The image forming apparatus according to claim 7, wherein the controller decreases the duty ratio when the supply current value exceeds the current limit value.

11. The image forming apparatus according to claim 1, wherein the heater is a halogen heater.

12. The image forming apparatus according to claim 1, wherein the voltage converter performs, plural times, the switching of the commercial alternating-current voltage in a period corresponding to a half period of the commercial alternating-current voltage, and thereby converts the commercial alternating-current voltage into the heater alternating-current voltage.

* * * * *